US006549740B2

(12) United States Patent
Yoneda et al.

(10) Patent No.: US 6,549,740 B2
(45) Date of Patent: Apr. 15, 2003

(54) IMAGE FORMING APPARATUS AND FIXING DEVICE THEREFOR

(75) Inventors: Shinsaku Yoneda, Kashihara (JP); Shinichi Uchida, Takatsuki (JP)

(73) Assignees: Kyocera Corporation, Kyoto (JP); Kyocera Mita Corporation, Osaka (JP)

( * ) Notice: Subject to any disclaimer, the term of this patent is extended or adjusted under 35 U.S.C. 154(b) by 0 days.

(21) Appl. No.: 09/947,998

(22) Filed: Sep. 6, 2001

(65) Prior Publication Data

US 2002/0028089 A1 Mar. 7, 2002

(30) Foreign Application Priority Data

| | | |
|---|---|---|
| Sep. 7, 2000 | (JP) | 2000-271741 |
| Oct. 10, 2000 | (JP) | 2000-309767 |
| Nov. 29, 2000 | (JP) | 2000-363512 |
| Dec. 26, 2000 | (JP) | 2000-395967 |
| Dec. 28, 2000 | (JP) | 2000-401303 |
| Jan. 31, 2001 | (JP) | 2001-023993 |
| Feb. 19, 2001 | (JP) | 2001-041280 |
| Mar. 1, 2001 | (JP) | 2001-057415 |

(51) Int. Cl.[7] ..... G03G 15/20
(52) U.S. Cl. ..... 399/122; 399/124
(58) Field of Search ..... 399/122, 124; 219/216; 432/60; 347/152, 156

(56) References Cited

U.S. PATENT DOCUMENTS 5,528,345 A * 6/1996 Hasegawa ..... 219/216
5,991,572 A * 11/1999 Cho ..... 399/122

* cited by examiner

*Primary Examiner*—Joan Pendegrass
(74) *Attorney, Agent, or Firm*—Jordan and Hamburg LLP

(57) ABSTRACT

A fixing device for use in an image forming apparatus in which a toner image is transferred and fixed onto recording paper. The image forming apparatus includes a housing made of a heat-resistant resin having an outside surface which serves as an outside surface of the fixing device. The housing includes two casings which are separable along a direction of conveyance or passage of the recording paper in the fixing device. One of the casing includes a mount section for holding a pair of rollers in a predetermined position in the fixing device. The other casing includes a paper outlet opening through which the paper is conveyed.

39 Claims, 35 Drawing Sheets

IMAGE FORMING APPARATUS AND FIXING DEVICE THEREFOR

BACKGROUND OF THE INVENTION

1. Field of the Invention

The present invention relates to a fixing device used in an image forming apparatus, such as a copying machine, printer, or facsimile apparatus using the electrophotographic way, and to an image forming apparatus provided with the same.

2. Description of Related Art

Conventionally, a fixing device used in an image forming apparatus comprises a pair of rollers, namely, a heating roller and a pressing roller, arranged inside a box-shaped metal housing constructed by attaching metal stays to a metal frame.

FIG. 35 is a sectional view showing a conventional fixing device 90. In the fixing device 90, a box-shaped metal housing is formed by uniting a lower stay base 91 and an upper stay base 92 of metallic material, as shown by hatched lines, by means of front and rear side plates made of metallic material (not illustrated).

A heating roller 93, a pressing roller 94, and a thermostat 95 and thermistor 96 which constitute a temperature detection sensor for detecting the temperature of the heating roller 93 are arranged inside the metal housing. Furthermore, a guide member 97 for guiding recording paper conveyed into the fixing device 90, a guide member 98 for guiding recording paper conveyed out from the fixing device 90, a separator unit 99 for separating the recording paper from the heating roller 93, a plurality of outer covers 100 made of synthetic resin for covering the outer surface of the metallic housing and the like are mounted on the outside of the metal housing.

However, in this construction, mounting parts are required according to components mounted in the metal housing, which consequently increases the number of parts constituting the fixing device 90. Also, a number of parts are mounted from various directions with respect to the housing, thereby complicating the assembly operation.

Moreover, in such fixing device, the housing is conventionally made to be separable along the path X—X in FIG. 35 that is the travel route of recording paper to handle paper blockages or jamming and other troubles.

However, in order to achieve positional accuracy of the heating roller 14 and the pressing roller 15 in such a construction, it is necessary to adopt a structure that two parts constituting the housing are firmly connected with each other while being separable. Consequently, it is necessary to use a material having a high strength such as metal and/or to provide reinforcing members in order to assure the necessary strength of the housing.

SUMMARY OF THE INVENTION

In view of the above-mentioned problems, it is an object of the present invention to provide a fixing device which assures easier assembly, and an image forming apparatus which is provided with the same.

According to an aspect of the present invention, a fixing device for use in an image forming apparatus in which a toner image is transferred and fixed on recording paper, comprises a housing made of a heat-resistant resin and having an outside surface which constitutes an outside surface of the fixing device. The housing includes a first casing and a second casing which are separable along the conveyance direction of recording paper in the fixing device (i.e., the direction of conveyance of the recording paper in its passage through the fixing device), and a mount section provided on an inside surface thereof for holding a pair of rollers in a predetermined position in the fixing device.

With this construction, since the pair of rollers are both supported in one of the two casings, the housing is not required to be provided in its entirety with the necessary high strength needed to assure the mutual positional registration of the pair of rollers while enabling separation of the housing. Consequently, the housing can be made of heat-resistant resin, while ensuring the required housing strength, and therefore it is possible to achieve a structure in which various components are readily assembled.

The pair of rollers may be supported in one of the casings which thus enables the easy assembling of the fixing device with the pair of rollers are mounted in that casing, and the other casing is thereafter on the first casing.

These and other objects, features, aspects, and advantages of the present invention will become more apparent from the following detailed description of the preferred embodiments/examples with reference to the accompanying drawings.

DESCRIPTION OF THE PREFERRED EMBODIMENTS

An image forming apparatus or printer provided with a fixing device in accordance with an embodiment of the present invention is described with reference to the drawings.

Figure 1:
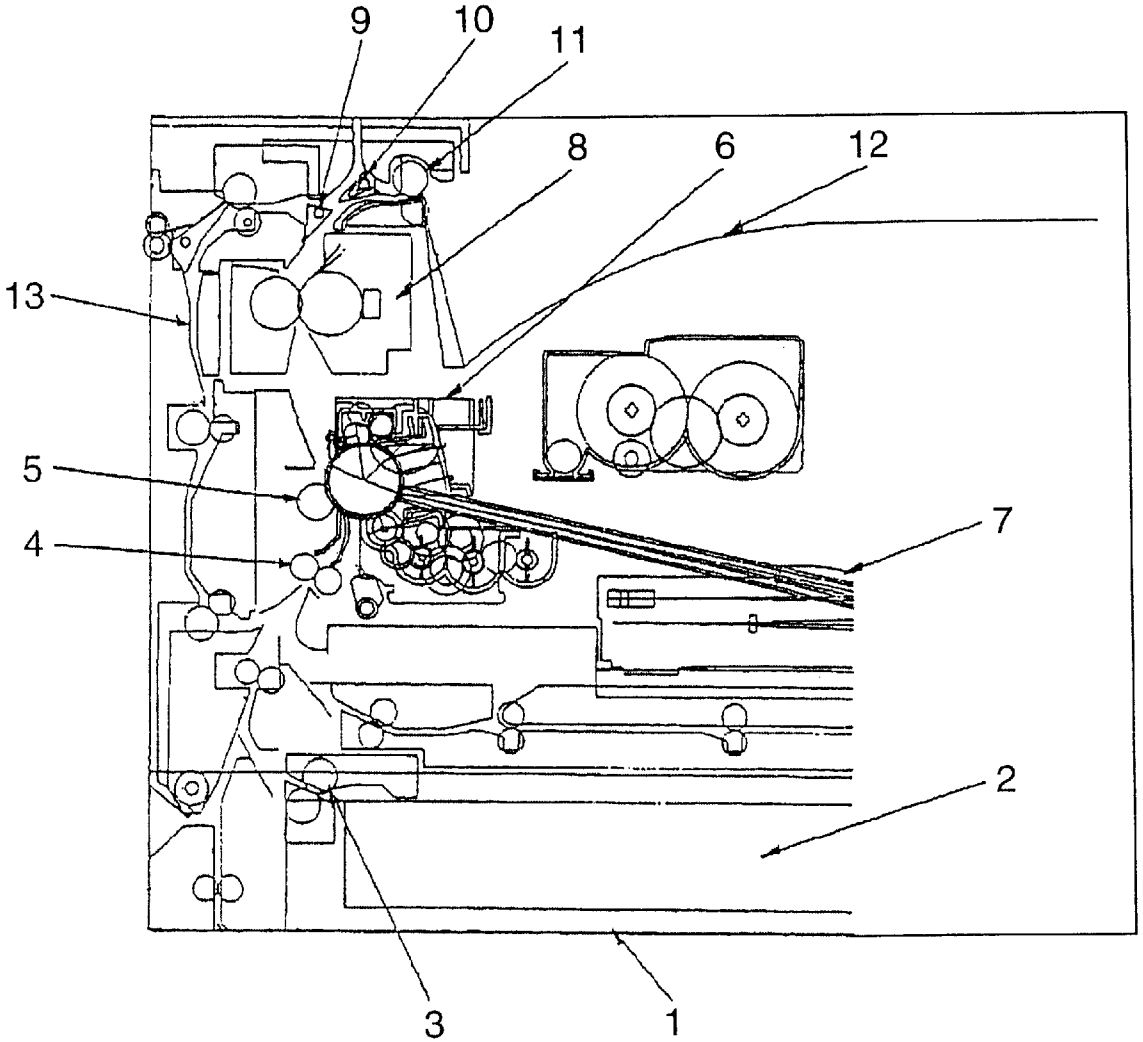
FIG. 1 is a schematic sectional view of a printer or an image forming apparatus provided with a fixing device in accordance with the present invention.

FIG. 1 is a sectional general view of an image forming apparatus in accordance with the invention. As shown in FIG. 1, the image forming apparatus 1 comprises a paper feed device 2; a paper feed roller section 3; a pair of resist rollers 4; a transfer roller 5; image forming unit 6 including a photosensitive drum and peripheral devices, such as a charging device; a laser unit 7; a fixing device 8; first output branching unit 9; second output branching unit 10; a pair of paper output rollers 11; a paper output section 12; and a double-side conveyance path 13.

Recording or copying paper stored in the paper feed device 2 in the bottom of the image forming apparatus 1 is conveyed to a main conveyance path formed in a substantially vertical direction by the paper feed roller section 3 until the front edge of the paper engages with the pair of resist rollers 4. A toner image is formed on the paper between the photosensitive drum of the image forming unit 6 and the transfer roller 5, and this toner image is fixed by the fixing device 8 thereby forming a fixed image on one side of the paper.

For single-side recording, the recording paper on which the toner image is fixed passes through the first output branching unit 9 and the second output branching unit 10 to the pair of paper output rollers 11 which convey it to the paper output section 12 provided on the upper face of the image forming apparatus 1.

For double-side recording, the pair of paper output rollers 11 halt rotation while retaining a small portion of the trailing edge of the conveyed recording paper, and thereafter they cause the recording paper to switch back by turning in reverse. The switched back recording paper is then conveyed again via the double-side conveyance path 13 to the main conveyance path, an image formed on the rear face thereof, and the paper is then output from the pair of paper output rollers 11 to the paper output section 12.

Figure 2:
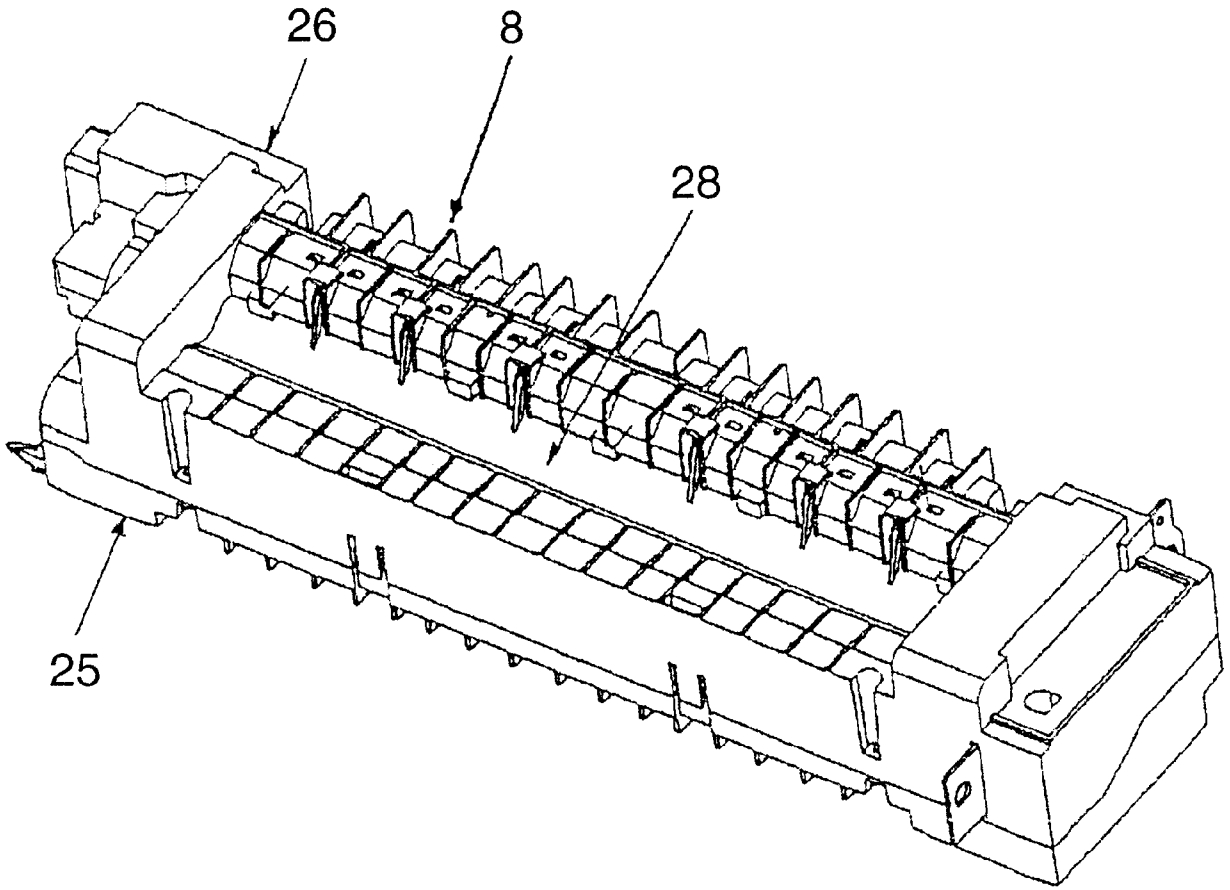
FIG. 2 is a perspective diagram of a fixing device viewed from obliquely above the same.
Figure 3:
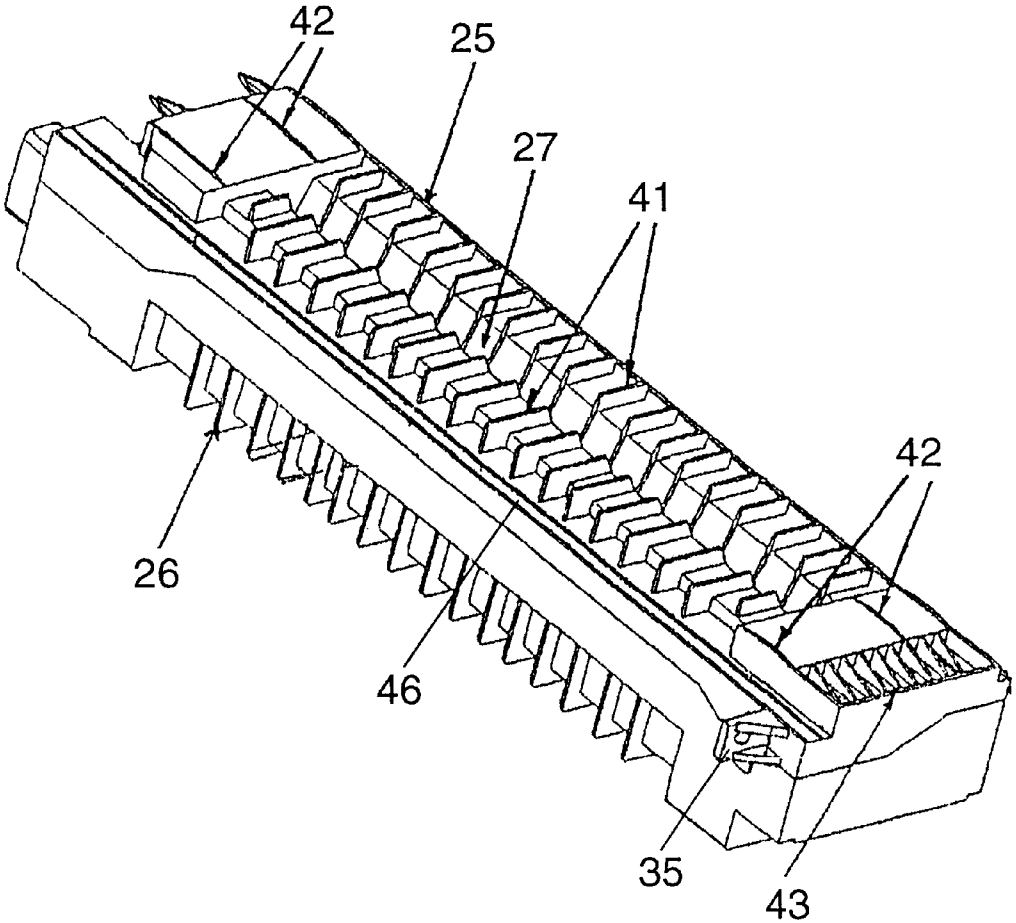
FIG. 3 is a perspective diagram of the fixing device viewed from obliquely below the same.
Figure 4:
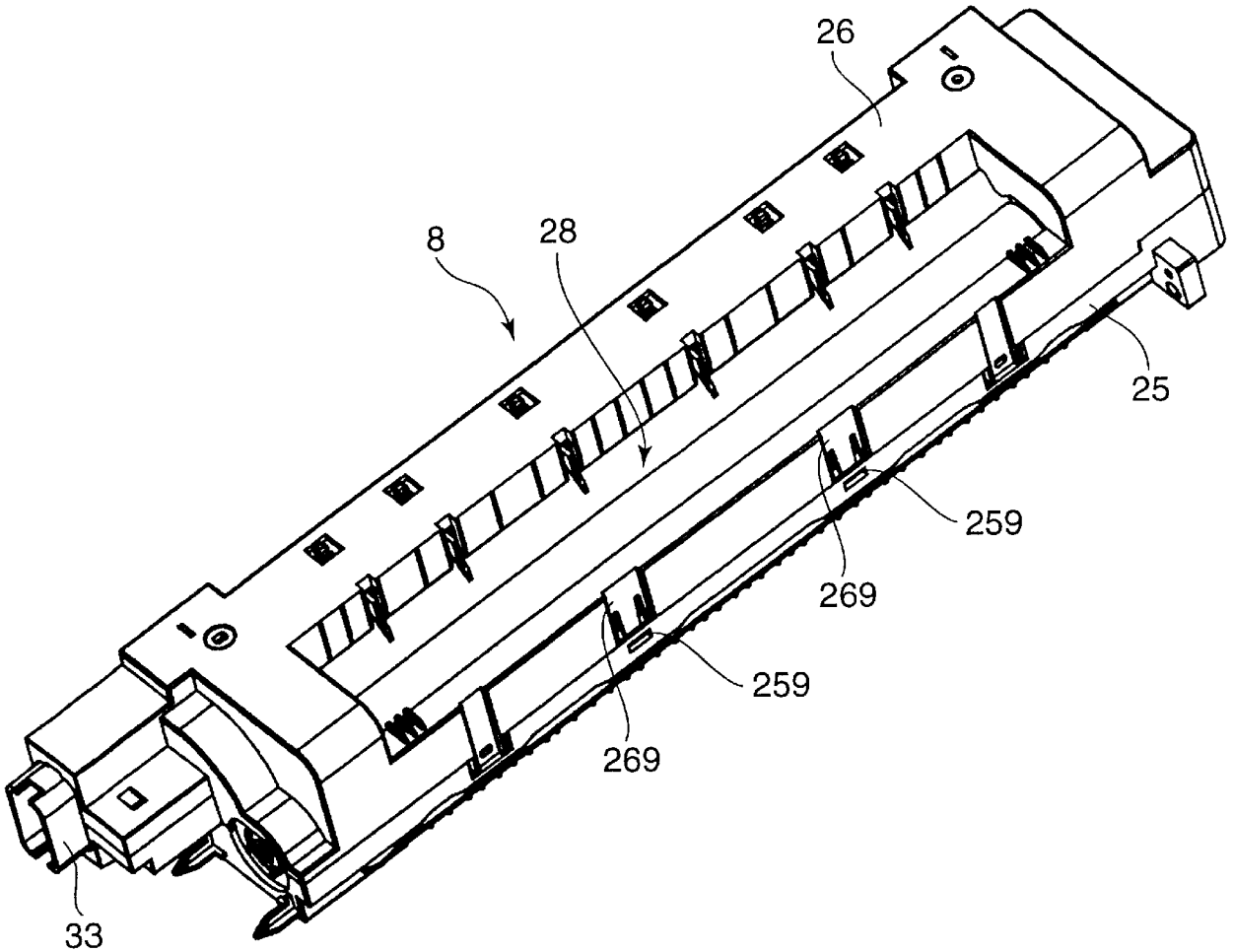
FIG. 4 is a perspective diagram of the fixing device viewed from obliquely behind the same.

Next, the fixing device provided in this image forming apparatus 1 will be described. FIG. 2 is a perspective diagram of the fixing device 8 viewed obliquely from above; FIG. 3 is a perspective diagram of the fixing device 8 viewed obliquely from below; and FIG. 4 is a perspective diagram of the fixing device 8 viewed obliquely from behind.

The fixing device 8 is provided with a housing formed by a molded synthetic resin, such as PET, PBT, or the like. An outside surface of the housing constitutes an outside surface of the device 8. This housing includes a first casing 25 and a second casing 26 which are separable along the direction in which the recording paper is conveyed inside the device 8. When the fixing device 8 is mounted in the image forming apparatus 1, the first casing 25 is positioned below the second casing 26. A paper inlet opening section 27 for conveying recording paper into the fixing device 8 is provided in the first casing 25, and a paper outlet opening section 28 for conveying recording paper, on which a toner image is fixed inside the fixing device 8, is provided in the second casing 26.

A plurality of rib-shaped projections 41 projecting in a downward direction (substantially upwards in FIG. 3) are formed about the inlet opening section 27 provided in the first casing 25. Furthermore, projecting sections 42 which project further downward than the rib-shaped projections 41 are formed to the front and rear of the rib-shaped projections 41. These projecting sections 42 define a placement plane for placing the first casing 25 on a preparation table when assembling the fixing device 8, and prevent the rib-shaped projections 41 from being damaged by abutting the preparation table. Furthermore, a gripping section 43 which is held by the operator when removing the fixing device 8 from the image forming apparatus 1 is formed on the front of the projecting section 42.

Figure 5:
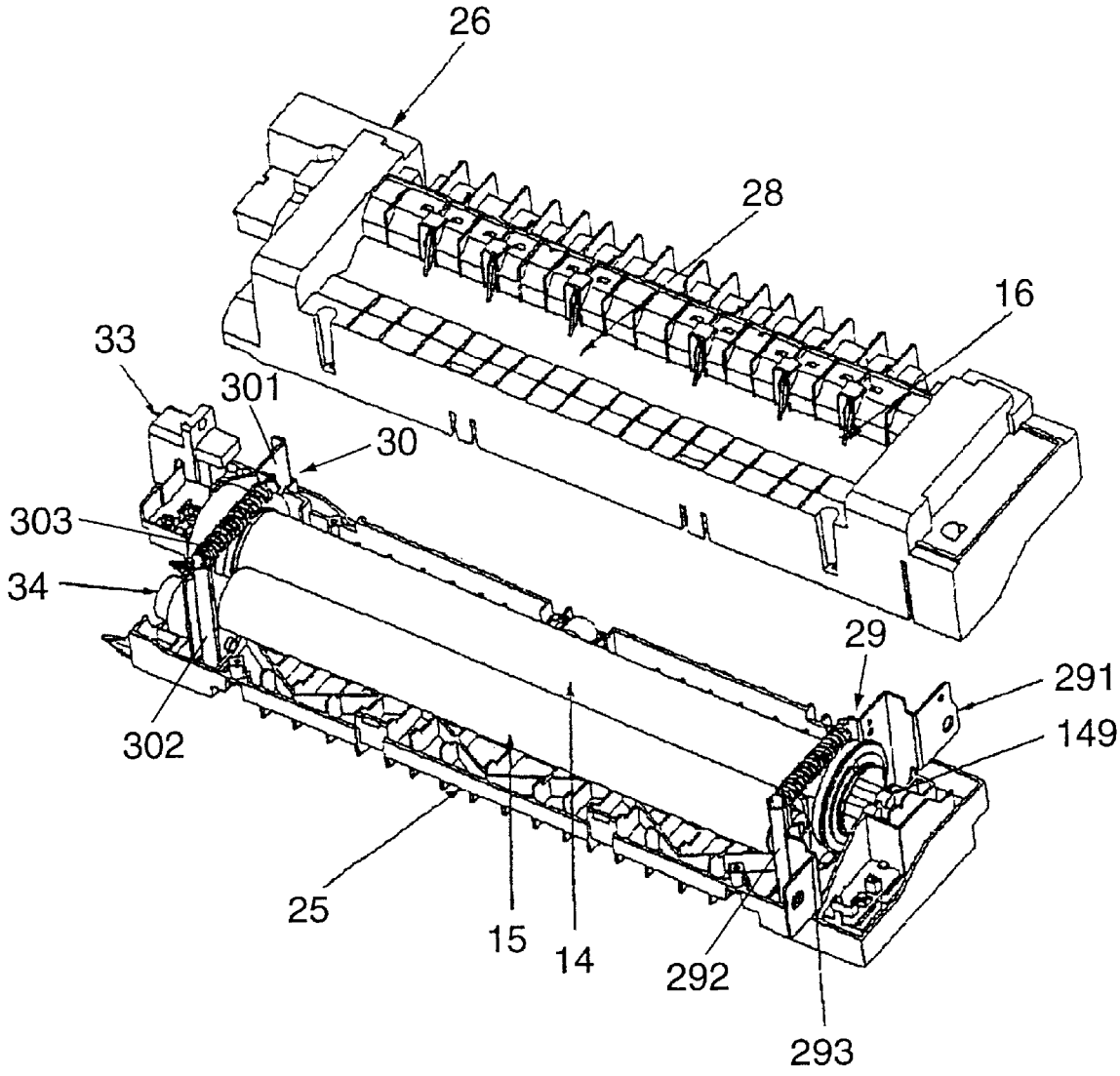
FIG. 5 is a perspective diagram of the fixing device wherein a first casing and a second casing are in a separated state.

FIG. 5 is a perspective view showing the first casing 25 and the second casing 26 of the fixing device 8 separated from one another.

As shown in FIG. 5, a pair of rollers, specifically, a heating roller 14 and a pressing roller 15, are accommodated inside the housing of the fixing device 8. When the fixing device 8 is mounted in the image forming apparatus 1, the heating roller 14 and the pressing roller 15 are arranged in substantially horizontal fashion. The pair of rollers are supported at each end thereof by means of roller support blocks, which consequently constitutes a fixing roller unit.

Figure 6:
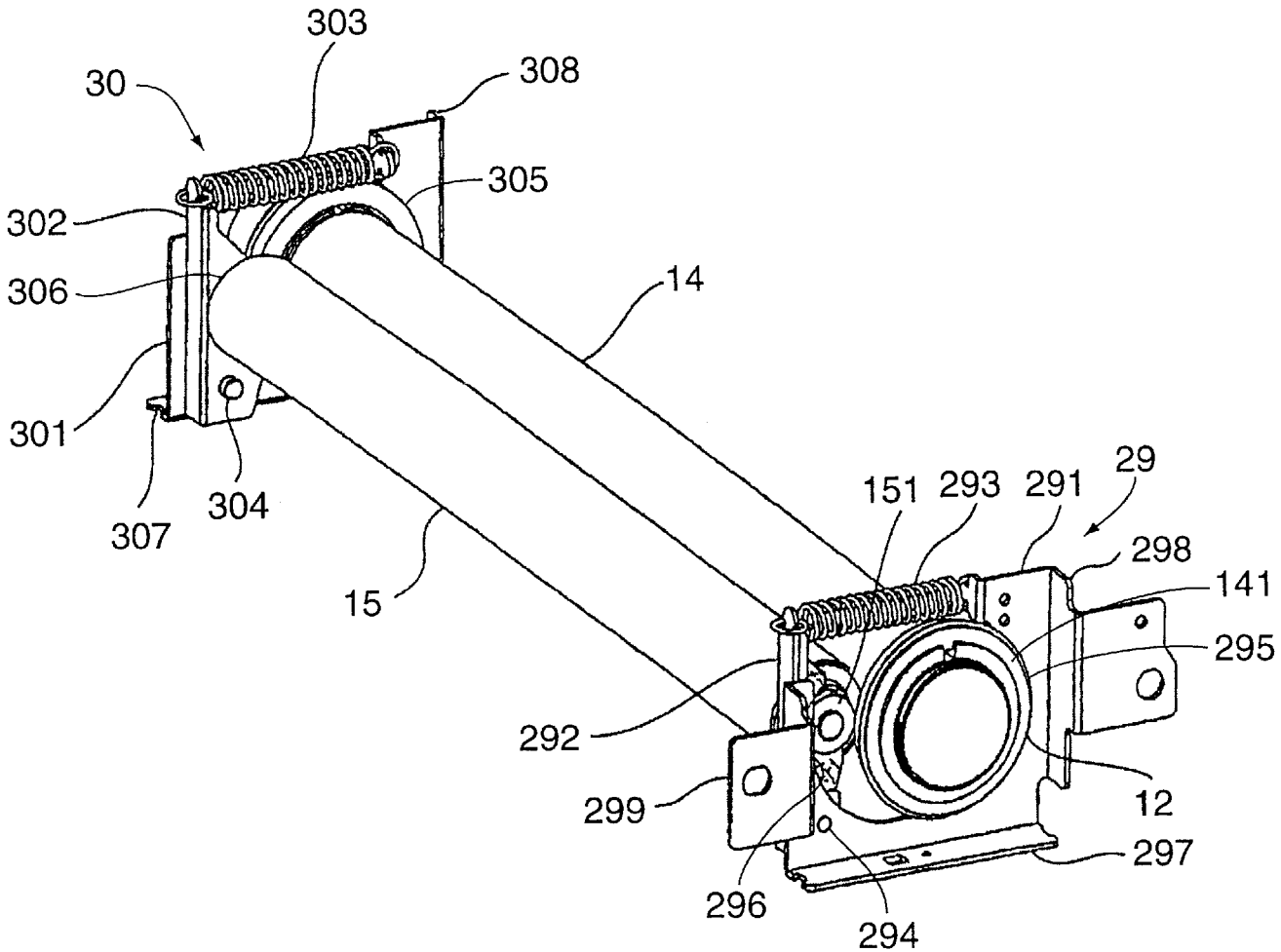
FIG. 6 is a perspective diagram showing a state wherein a fixing roller unit is removed from the fixing device.

FIG. 6 is a perspective diagram showing the fixing roller unit dismounted from the fixing device 8. As shown in FIG. 6, in the fixing roller unit, the roller support blocks supporting the heating roller 14 and the pressing roller 15 comprise a front roller support portion 29 for supporting the respective front ends of the both rollers of the pair, and a rear roller support portion 30 for supporting the respective rear ends of the both rollers of the pair.

The front roller support portion 29 comprises a front frame 291 for supporting the front end of the heating roller 14, a pressing lever 292 for supporting the front end of the pressing roller 15, a pressing lever pin 294 forming a fulcrum about which the pressing lever 292 is supported rotatably on the front frame 291, and an urging or biasing spring 293 forming an urging or biasing member for urging or biasing the pressing lever 292 against the front frame 291.

The front frame 291 is made of a substantially rectangular metallic plate in which an upwardly opening U-shaped opening is formed, a recess 295 which fits a bearing 141 on the front end of the heating roller 14 being provided in the inner side portion of the U-shaped opening, whereby the heating roller 14 is supported in a rotatable fashion.

The pressing lever 292 is provided with a recess 296 which fits a bearing 151 on the front end of the pressing roller 15 at a position facing the recess 295 of the front frame, whereby the pressing roller 15 is supported in a rotatable fashion.

The pressing lever pin 294 and the spring 293 are arranged on either side, above and below, the mounting positions of the fixing rollers 14, 15. The two ends of the spring 293 engage with the front frame 291 and the upper portion of the pressing lever 292, and by thus pressing the pressing lever 292 towards the front frame 291, the pressing roller 15 is caused to press against the heating roller 14.

The lower edge portion and the left and right-hand edge portions of the front frame 291 are bent towards the front to form frame bend sections 297, 298, 299, which, in addition to guaranteeing higher mechanical strength than a flat shape, also ensure good accuracy in the mounting position onto the first casing 25 and the second casing 26, as described hereinafter. Mounting holes which are continuous with the main body of the image forming apparatus 1 are formed in the frame bend section 298, 299, of the front frame 291, such that the fixing device 8 mounted in the main body of the image forming apparatus 1 can be secured.

The rear roller support portion 30 comprises a rear frame 301 for supporting the rear end of the heating roller 14, a pressing lever 302 for supporting the rear end of the pressing roller 15, a pressing lever pin 304 forming a fulcrum for supporting the pressing lever 302 rotatably on the rear frame 301, and an urging or biasing spring 303 forming an urging biasing member for urging or biasing the pressing lever 302 towards the rear frame 301, and similarly to the front support block 29 described above, the pressing roller 15 is pressed against the heating roller 14, while the bearing 141 of the heating roller 14 and the bearing 151 of the pressing roller 15 are respectively held rotatably in recesses 305, 306 provided in the rear frame 301 and the pressing lever 302.

The lower edge portion and the right-hand edge portion of the rear frame 301 are bent towards the rear to form frame bend sections 307, 308, which, in addition to guaranteeing higher mechanical strength than a flat shape, also ensure good accuracy in the mounting position onto the first casing 25 and the second casing 26, as described hereinafter.

Next, the structure for mounting the fixing roller unit in the housing of the fixing device 8 will be described.

The fixing device 8 is constructed by first assembling the constituent parts of the fixing roller unit, and the like, onto the first casing 25, and then placing the second casing 26 on the first casing 25 and fastening them.

Figure 7:
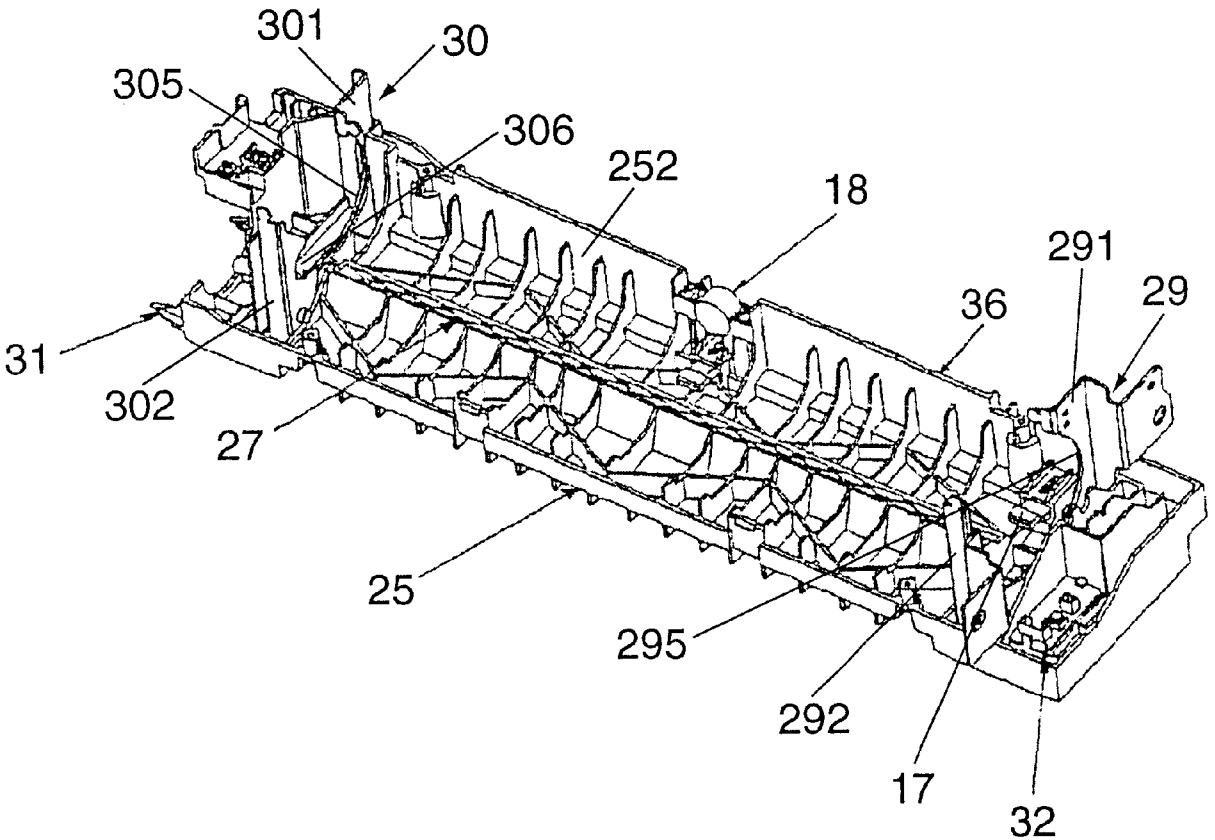
FIG. 7 is a perspective diagram showing a state wherein a front roller support block and a rear roller support block of a fixing roller unit are assembled in the first casing.

FIG. 7 shows a state where the front roller support portion 29 of the fixing roller unit and the rear roller support portion 30 are mounted onto the first casing 25. In this state, the springs 293, 303 are not mounted.

Figure 8:
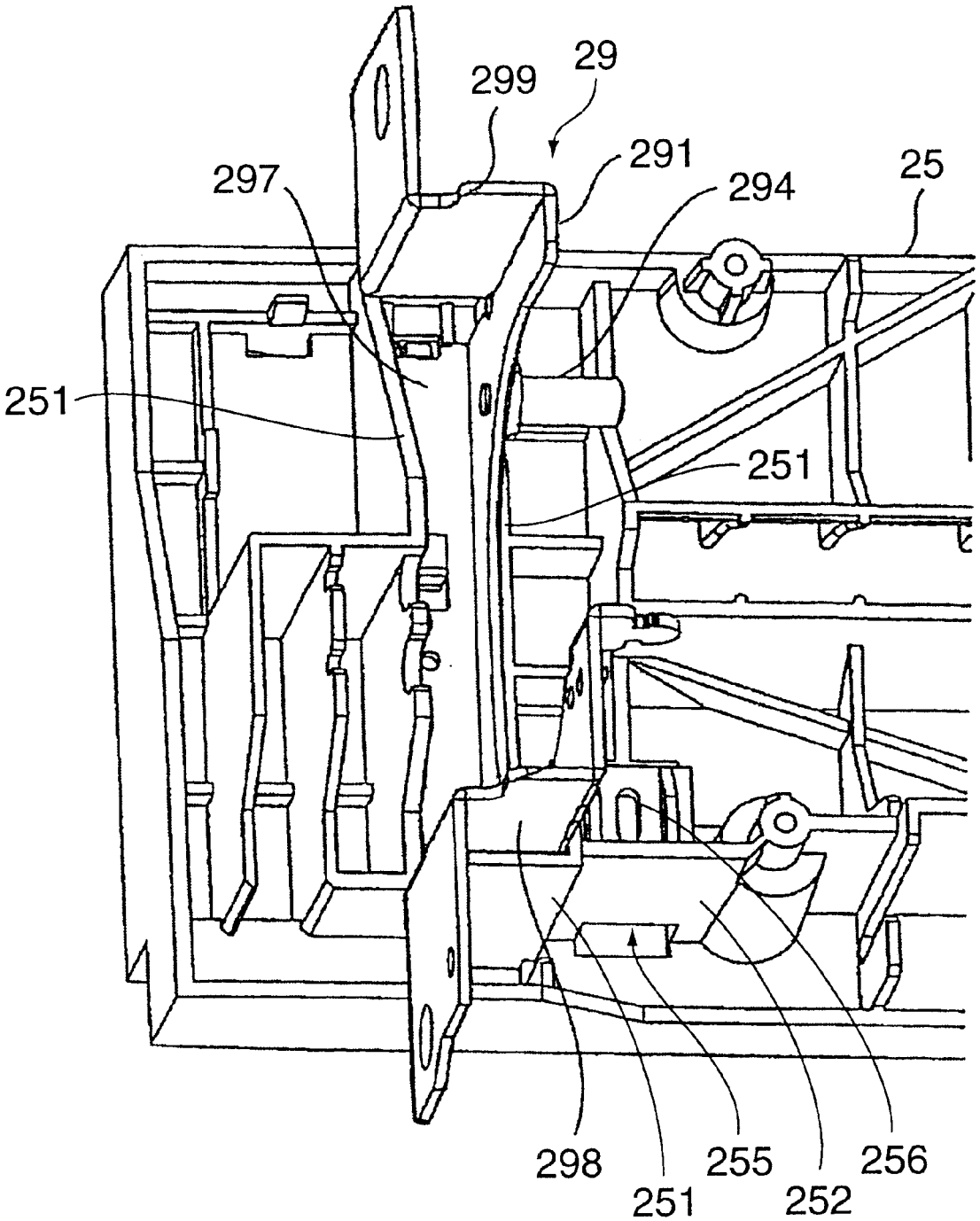
FIG. 8 is an enlarged perspective diagram of a portion wherein the front roller support block is mounted in the first casing.
Figure 9:
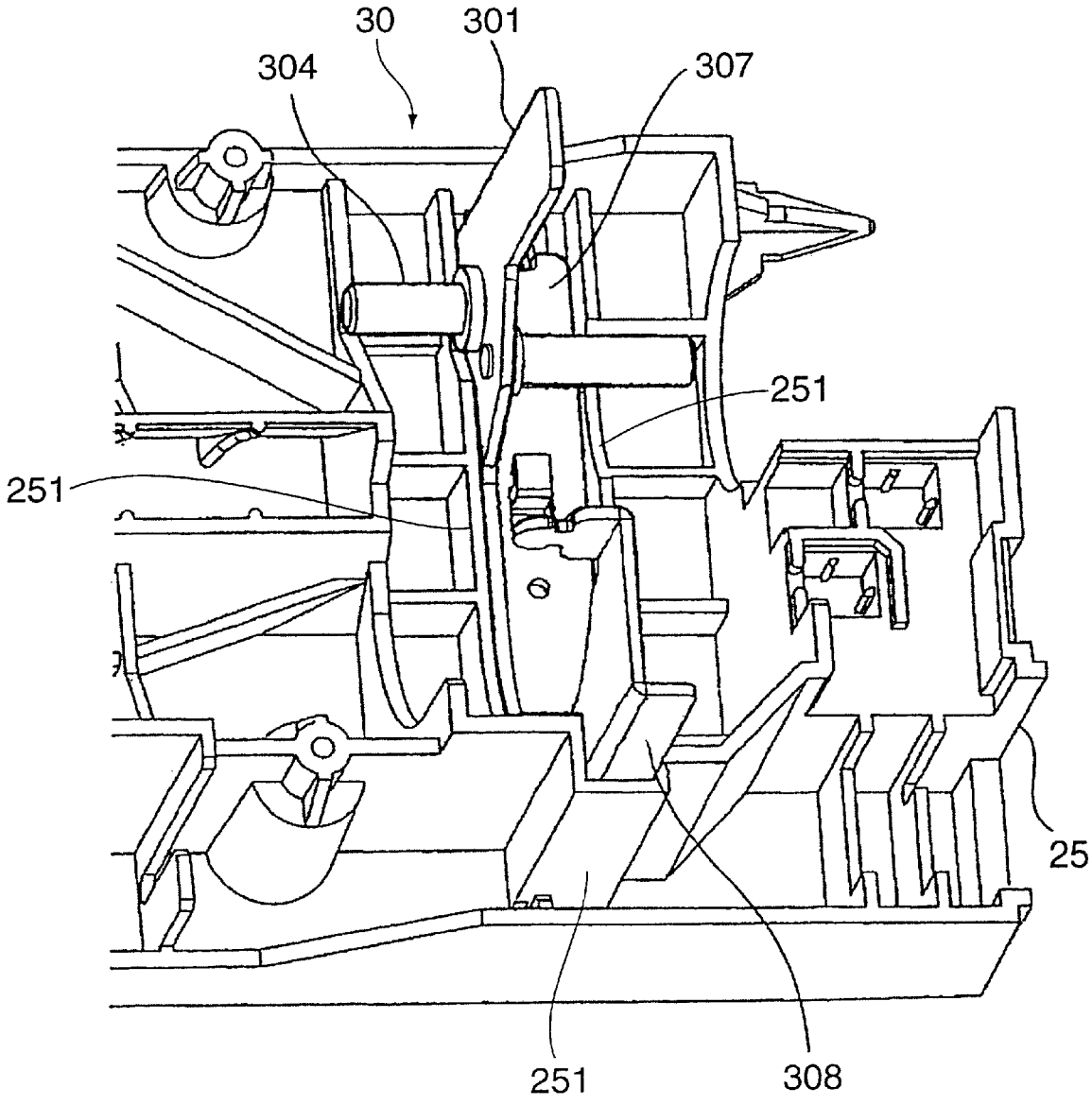
FIG. 9 is an enlarged perspective diagram of a portion wherein the rear roller support portion is mounted in the first casing.

FIG. 8 is an enlarged perspective diagram of a portion where the front roller support portion 29 is mounted on the first casing 25. FIG. 9 is an enlarged perspective diagram of a portion where the rear roller support portion 30 is mounted on the first casing 25.

As shown in FIGS. 7 and 8, the inside surface of the first casing 25 is provided with mount sections 251 for holding the front frame 291 of the front roller support portion 29 and the rear frame 301 of the rear roller support portion 30, in their predetermined positions. These mount sections 251 are constituted by mounting ribs which project from the inside surface of the housing and surround the lower edge portion and side edge portions of the front frame 291 and the rear frame 301, thereby forming guide spaces which accommodate and guide the front frame 291 and the rear frame 301.

As described above, frame bend sections 297, 298, 299, 307, 308 are formed on the front frame 291 and the rear frame 301. Since the front frame 291 and the rear frame 301 are supported owing to that these frame bend sections 297, 298, 299, 307, 308 fit into the mount sections 251, the front frame 291 and the rear frame 301 can be easily mounted to a high degree of positional accuracy in their predetermined positions in the inside of the first casing 25. Moreover, the attachment of the front frame 291 and the rear frame 301 to the mount sections 251 of the first casing 25 may be accomplished simply by press fitting, or it may involve screw fastening, or the like.

At an intermediate stage of the assembly of the fixing device 8, the front frame 291 and the rear frame 301 are held provisionally in their predetermined positions by being fitted into the mount sections 251. Therefore, it is not necessary to support the front frame 291 and the rear frame 301 by means of special jigs, or the like, during assembly, and hence the assembly can be accomplished simply.

Figure 10:
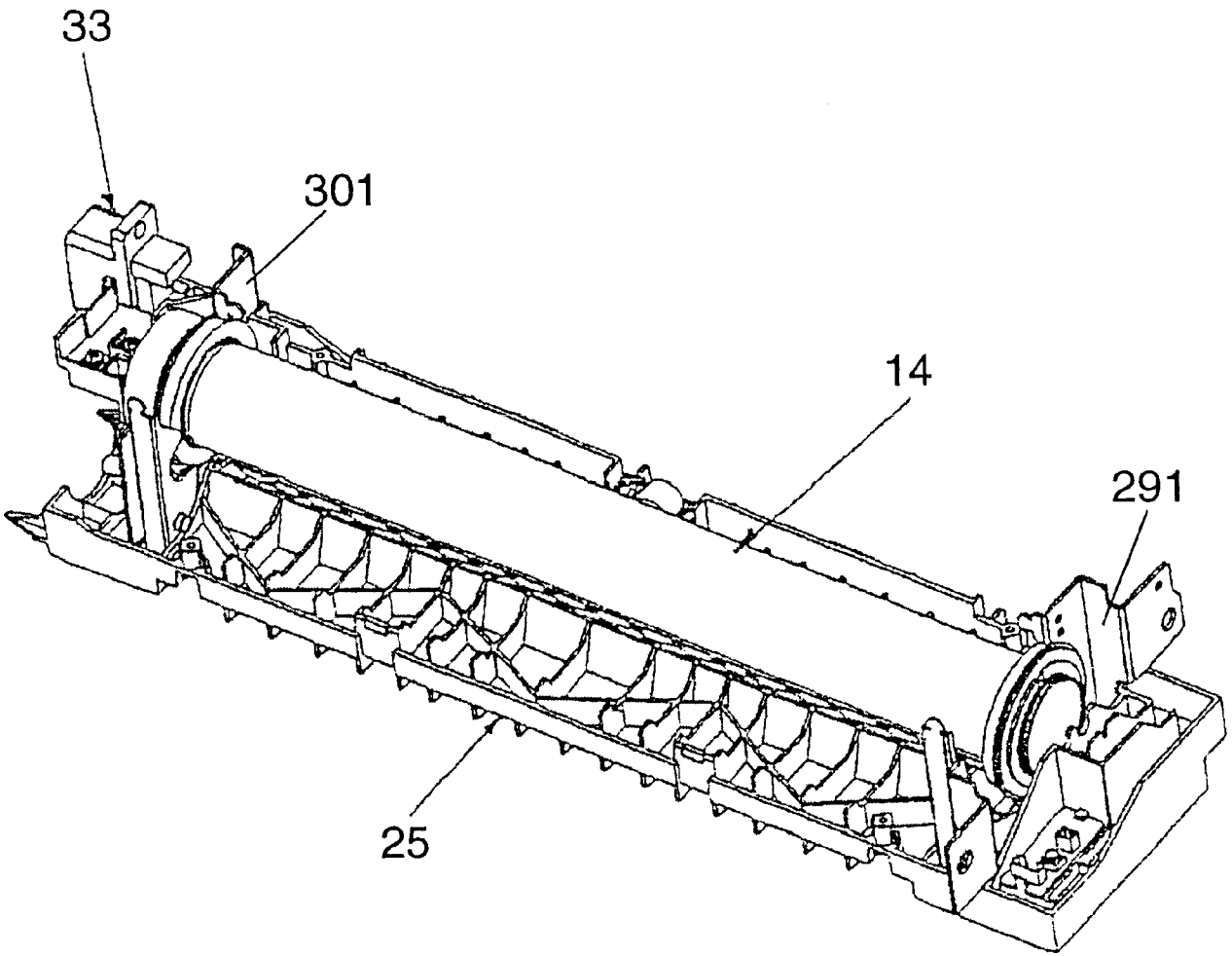
FIG. 10 is a perspective diagram showing a state wherein a heating roller is mounted in the state shown in FIG. 7.
Figure 11:
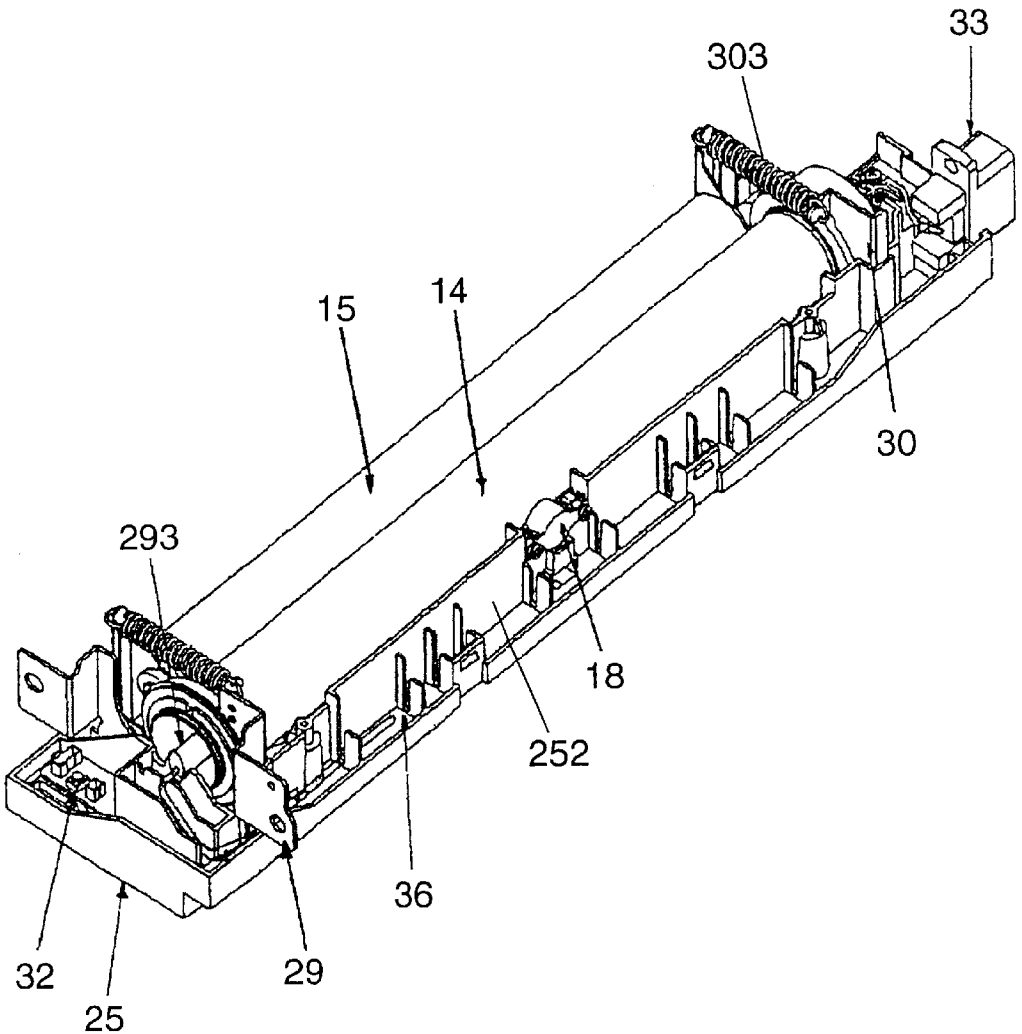
FIG. 11 is a perspective diagram showing a state wherein a pressing roller and urging or biasing springs are mounted in the state shown in FIG. 10.
Figure 19:
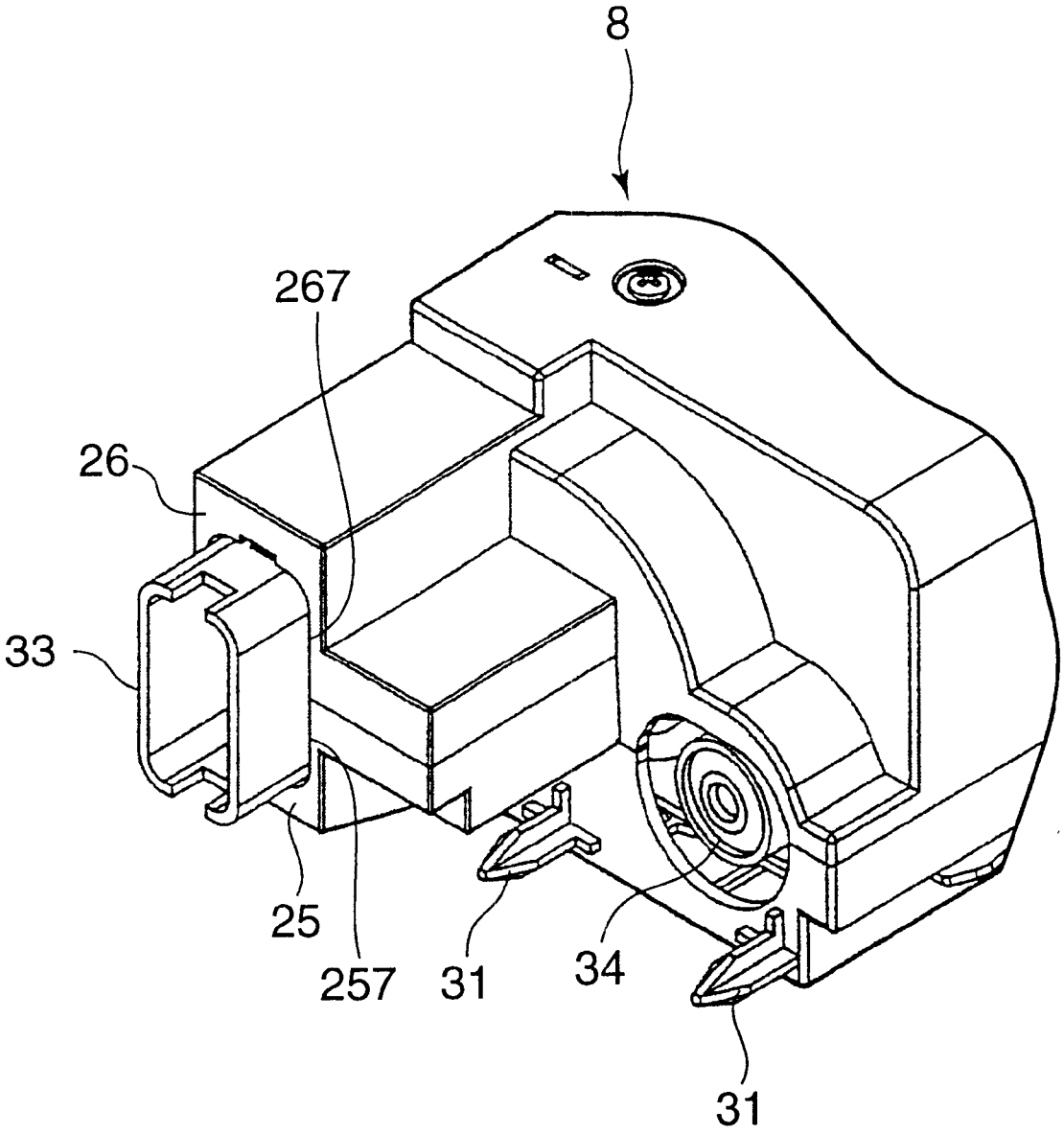
FIG. 19 is a perspective diagram showing a rear side portion of the fixing device.

FIG. 10 shows a state where a heating roller 14 is mounted in the state shown in FIG. 7. FIG. 11 shows a state where the pressing roller 15 and the springs 293, 303 are mounted in the state shown in FIG. 10. In FIG. 7, FIG. 19 and FIG. 11, constituent parts, such as a thermistor 17, thermostat 18, temperature circuit board 32, connector 33, and the like, are also mounted on the first casing 25, and the assembly structure for these parts is described hereinafter.

Figure 12:
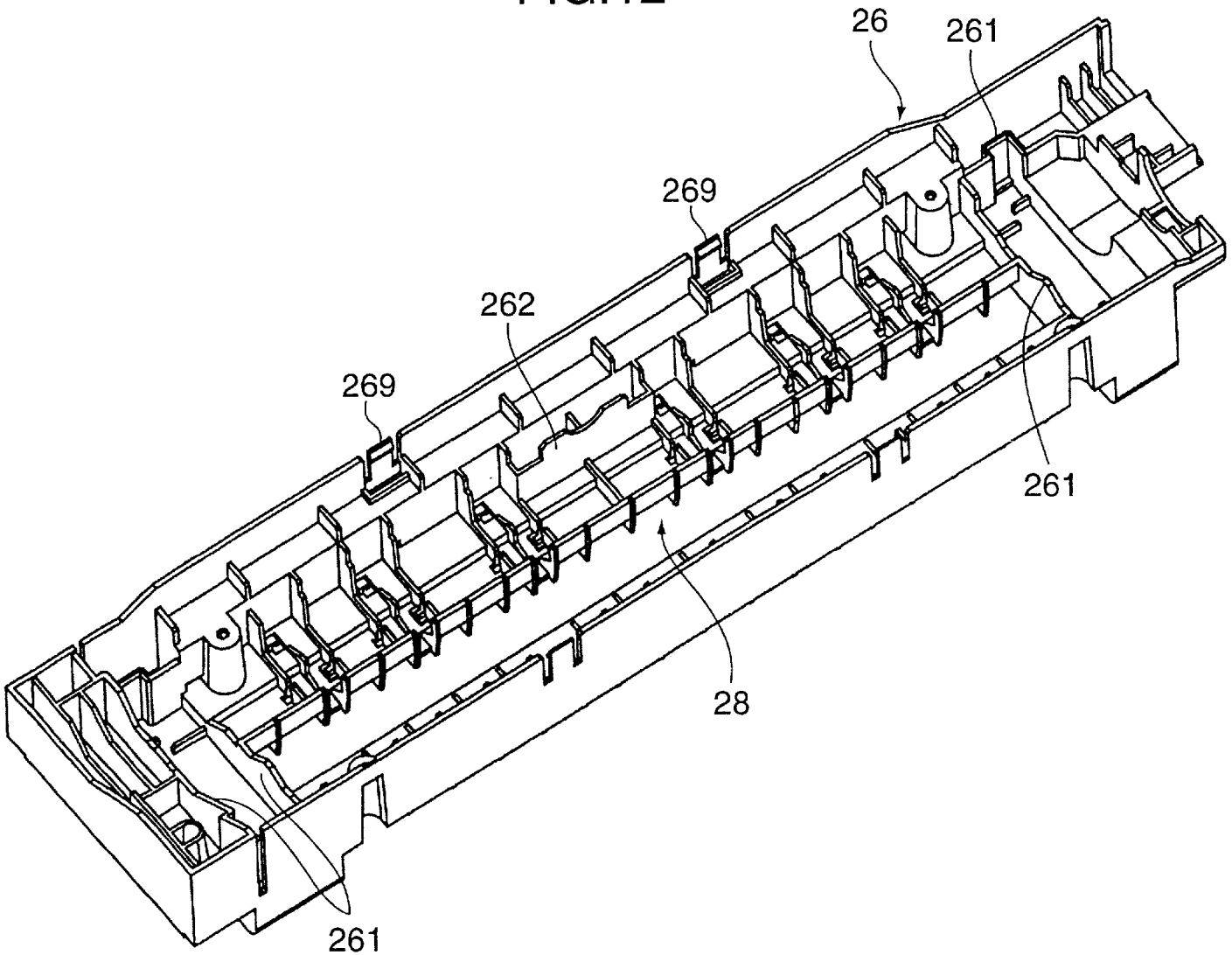
FIG. 12 is a perspective diagram of a second casing viewed from below or inside.
Figure 13:
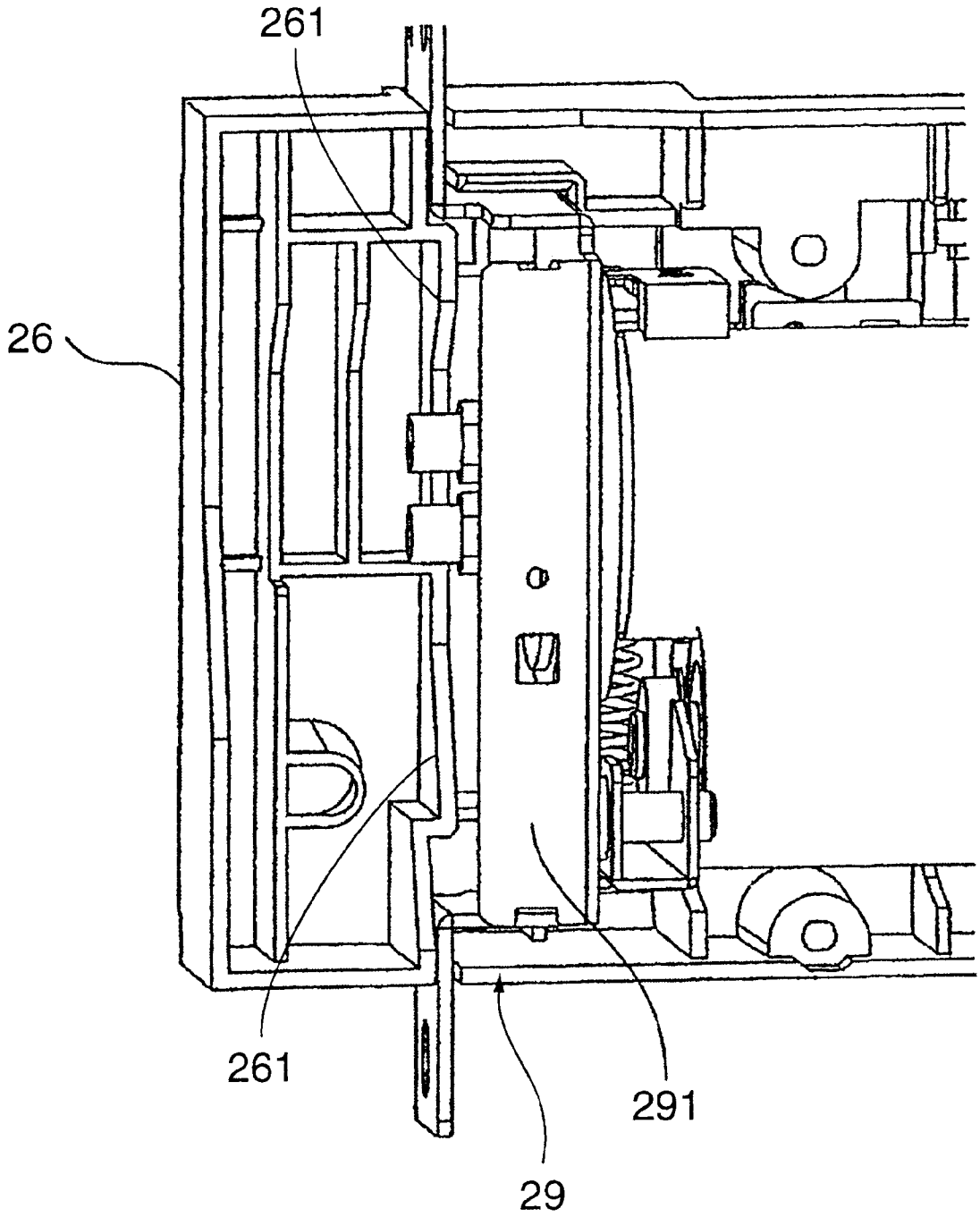
FIG. 13 is an enlarged perspective diagram of a portion wherein the front roller support block is mounted in the second casing.
Figure 14:
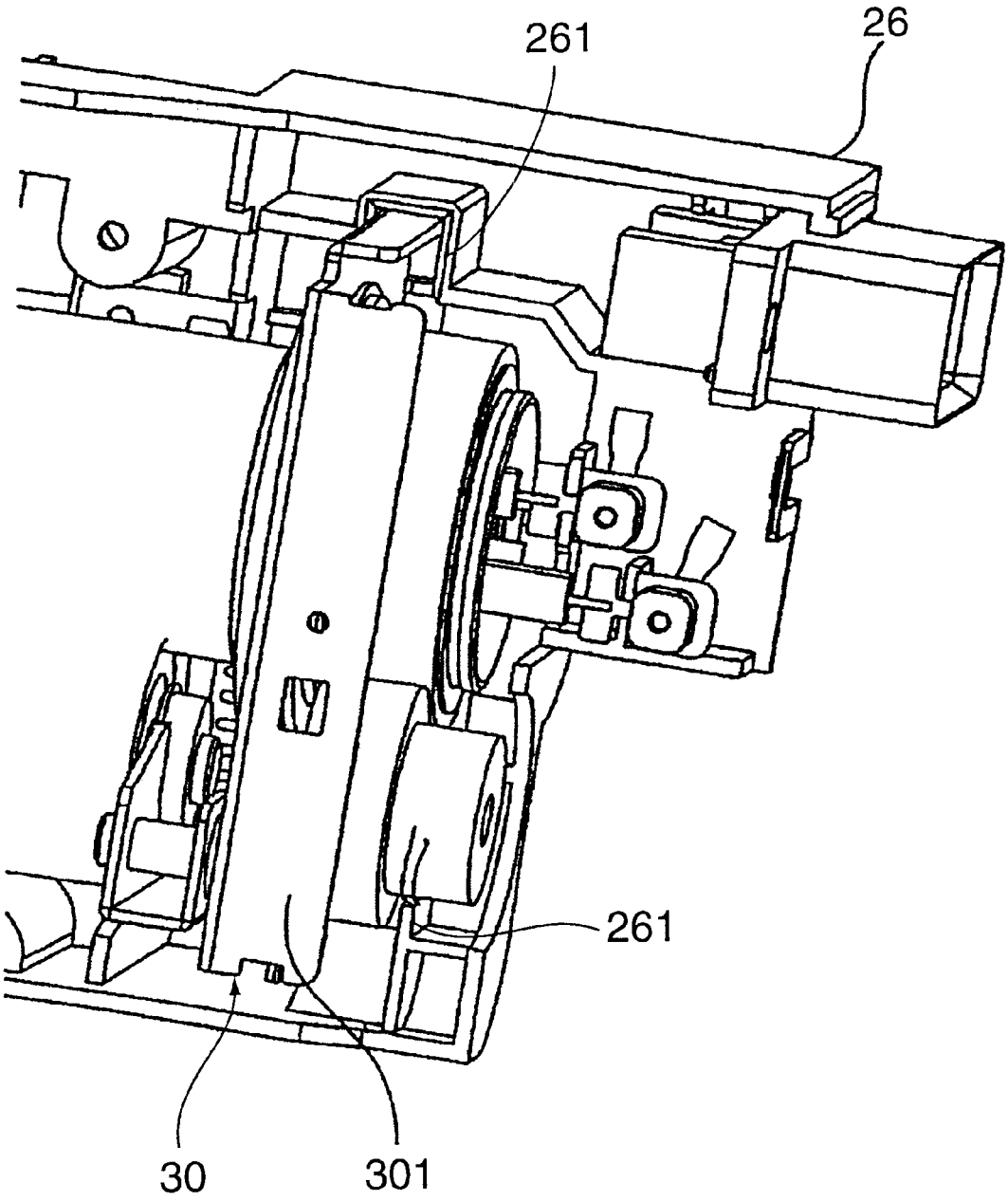
FIG. 14 is an enlarged perspective view of a portion wherein the rear roller support block is mounted in the second casing.

FIG. 12 is a perspective diagram of the second casing 26 viewed from below or inside. FIG. 13 is an enlarged perspective diagram of a portion where the front roller support portion 29 is mounted on the second casing 26. FIG. 14 is an enlarged perspective view showing the rear roller support portion 30 mounted on the second casing 26.

As shown in FIGS. 12–14, retaining sections 261 are provided on the inner surface of the second casing 26 for securing the front frame 291 and the rear frame 301 in their predetermined mount positions by fastening and pressing down from above on the front frame 291 and the rear frame 301 provisionally held by the mount sections 251 of the first casing 25, when the second casing 26 is placed onto the first casing 25. These retaining sections 261 are constituted by retaining ribs which project from the inner surface of the case and surround the upper edge portion and side edge portions of the front frame 291 and the rear frame 301, thereby forming guide spaces which accommodates and guide the front frame 291 and the rear frame 301.

The front frame 291 and the rear frame 301, by being regulated or fixed in position with respect to the mount sections 251 of the first casing 25 and the mount sections 261 of the second casing 26, function as positioning guides for regulating the coupling position of the first casing 25 and the second casing 26.

By taking the first casing 25 as shown in FIG. 11 with the respective constituent components assembled thereon, placing the second casing 26 as illustrated in FIG. 12 thereon, as shown in FIG. 5, and coupling the engaging holes 259 provided in the first casing 25 with the engaging sections 269 formed in the second casing 26, as shown in FIG. 4, the first casing 25 and the second casing 26 are coupled together, and the fixing device 8 as illustrated in FIG. 2, FIG. 3, and FIG. 4 is assembled.

As described hereinafter, the fixing device 8 thus assembled is mounted in the main body of the image forming apparatus 1 by inserting it therein, taking the axial direction of the heat roller 14 and the pressing roller 15 as the direction of insertion.

Figure 15:
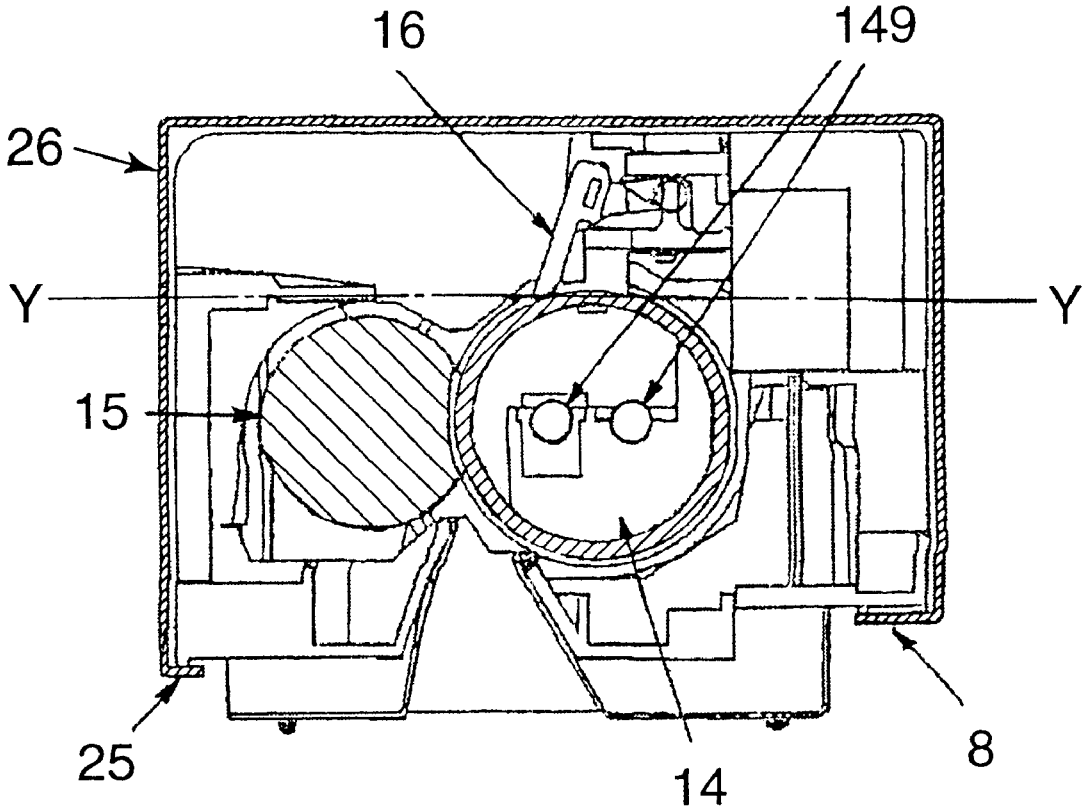
FIG. 15 is a sectional view of a fixing device.

FIG. 15 is a sectional view of the fixing device 8. As shown in FIG. 15, the housing of the fixing device 8 is assembled by means of the first casing 25 and the second casing 26 which separate along the line Y—Y in FIG. 15.

According to the fixing device constituted in the aforementioned manner, since the housing can be separated along the direction of travel of the recording paper, and the mount sections 251 supporting both rollers 14, 15 of the pair of rollers are provided in one portion of the housing, namely, the first casing 25, then the relative positional regulation of the rollers 14, 15 can be achieved in the first casing 25 alone, and hence the strength required in the housing in order to assure the relative positions of the rollers 14, 15 can be ensured readily, by means of a simple construction. This means that, in comparison to a conventional fixing device constituted by coupling two casings each supporting one roller, where a larger strength is required in the coupling sections of the casings in order to assure the relative positions of the two rollers by coupling the two cases, the fixing device having the aforementioned construction does not need the high strength for casing coupling required in the prior art. As a result, it is possible to manufacture the housing from heat-resistant resin which is readily molded into complex forms.

By manufacturing the housing from heat-resistant resin, it is possible to significantly reduce the number of components used to make the fixing device 8 and hence lower the cost of the fixing device 8, compared to the prior art, while ensuring the strength required in the housing of the fixing device 8.

Since the first casing 25 holds both rollers 14, 15 of the fixing roller pair, it is possible to assemble the fixing device in a simple fashion, by mounting the two rollers 14, 15 of the fixing roller pair in the first casing 25, and then placing the second casing 26 thereon.

Furthermore, since the retaining sections 261 are arranged in the second casing 26, it is possible to secure the pair of rollers reliably in their predetermined positions in the fixing device 8, by means of the fixing roller pair being held between these retaining sections 261 and the mount sections 251 in the first casing 25.

Since the mount sections 251 in the first casing 25 are constituted so as to provisionally hold the pair of rollers, independently of the retaining sections 261 in the second casing 26, assembly of the fixing device 8 can be performed readily, without requiring special jigs, or the like, for provisionally holding the pair of rollers during the assembly of the fixing device 8.

In addition, since the pair of rollers are held provisionally by the first casing 25 during maintenance of the fixing device 8, the task of maintaining the fixing device 8 can also be performed readily.

Since the heating roller 14 and the pressing roller 15 are arranged in substantially horizontal fashion when the fixing device 8 is mounted in the main body of the image forming apparatus 1, it is possible to achieve vertical conveyance whereby the recording paper is conveyed through the fixing device 8 in a vertical direction, and hence a compact design for the image forming apparatus 1 occupying little floor space can be achieved.

Furthermore, since the fixing device 8 is mounted in the image forming apparatus 1 in such a fashion that the first casing 25 is positioned below the second casing 26, then after positioning the first casing 25 on a preparation table, and mounting the pair of rollers and the like, from above, the second casing can be placed thereon and the unit mounted in this same position into the main body of the image forming apparatus 1, and hence the ease of operation from assembly of the fixing device 8 to mounting in the image forming apparatus 1 is good.

Furthermore, since the first casing 25 supports the pair of rollers from below, even when the fixing device 8 is mounted in the image forming apparatus 1, the positions of the pair of rollers are stable.

Japanese Examined Utility Model Publication No. (Hei) 5-48207 discloses a fixing device wherein a heating roller and a pressing roller are respectively mounted in an upper frame and a lower frame in a vertical arrangement such that the heating roller and the pressing roller are pressed together, the recording paper being fixed by passing it through the nip section thereof, and the heating roller and the pressing roller being readily exchangeable by separating the upper and lower frames. However, in this fixing device, since the heating roller, pressing roller, urging or biasing member, and the like, are accommodated inside a metal housing, and an outer cover made from heat-resistant resin is provided in order to achieve temperature protection, high-temperature operability and guide functions, the number of components is high and assembly is complicated.

Japanese Unexamined Patent Publication No. (Hei)9-16007 discloses a fixing device wherein the housing is made of heat-resistant resin, either end of a heating roller and pressing roller respectively being supported rotatably by reinforcing plates, and both reinforcing plates being coupled by a support axle in order to reinforce the housing. This fixing device is susceptible to twisting and vibrations caused by rotational load and requires a support axle to strengthen the two reinforcing plates. Thus, this fixing device has disadvantages both in terms of performance and the number of parts.

In view of these circumstances, in the fixing device in accordance with the present invention as described above, an upwardly opening U-shaped opening section is formed in the front frame 291 and the rear frame 301, whereby the heating roller 14 and the pressing roller 15 can be assembled readily from either side of the opening.

Since the front roller support portion 29 and the rear roller support portion 30 are constituted by a smaller number of components, namely, the front frame 291, rear frame 301, pressing levers 292, 302, and springs 293, 303, then from this viewpoint also, the fixing device 8 can be manufactured inexpensively.

Furthermore, since the strength of the front frame 291 and the rear frame 301 is ensured by forming the frame bend sections 297, 298, 299, 307, 308 in the edge portions thereof, the front frame 291 and the rear frame 301 do not bend, even when stress due to twisting, rotational load, or the like, is applied thereto. Therefore, it is possible to maintain a uniform nip pressure between the heating roller 14 and the pressing roller 15, and hence to perform reliable fixing.

In a conventional fixing device, in many cases, the heating roller or the pressing roller is in an exposed state via the inlet opening section for the recording paper, the user being able inadvertently to touch the constituent parts in the fixing device when dealing with paper jams, or the like, this type of occurrence being particularly liable to occur in the case of compact fixing devices, but in the fixing device having the construction described above, since the rib-shaped projections 41 are provided on the lower side of the fixing device 8 which is held by the user when mounting or removing the fixing device 8 with respect to the image forming apparatus 1, it is possible to prevent in advance the user's hand from entering inside the device 8 via the inlet opening section 27 and touching the heating roller 14, or the like, which is at high temperature inside the fixing device 8. From this viewpoint, desirably, the rib-shaped projections 41 should have a height of 5 mm or above, and a pitch of 10 mm or less.

Since these rib-shaped projections 41 also function as heat radiating fins, it is possible to obtain a cooling effect for the fixing device 8 overall. Moreover, it is also possible to reduce transmission of heat from the fixing device 8 to the surface of the image forming apparatus 1 where the fixing device 8 is arranged therein.

Moreover, since the first casing 25 and the second casing 26 are coupled by means of fitting together respectively provided engaging sections 259 and engaging holes 269, it is possible for the first casing 25 and the second casing 26 to be dismantled after being coupled together. Accordingly, in the event of failure of or damage to component parts of the fixing device 8, the corresponding parts can be repaired or replaced readily by detaching the second casing 26 from the first casing 25.

The construction for assembling other components to the fixing device 8, apart from the fixing roller unit will be next described. Initially, the assembly construction for temperature control sensors mounted near the heating roller 14 and used for controlling the temperature of the heater 149 will be described.

Figure 16:
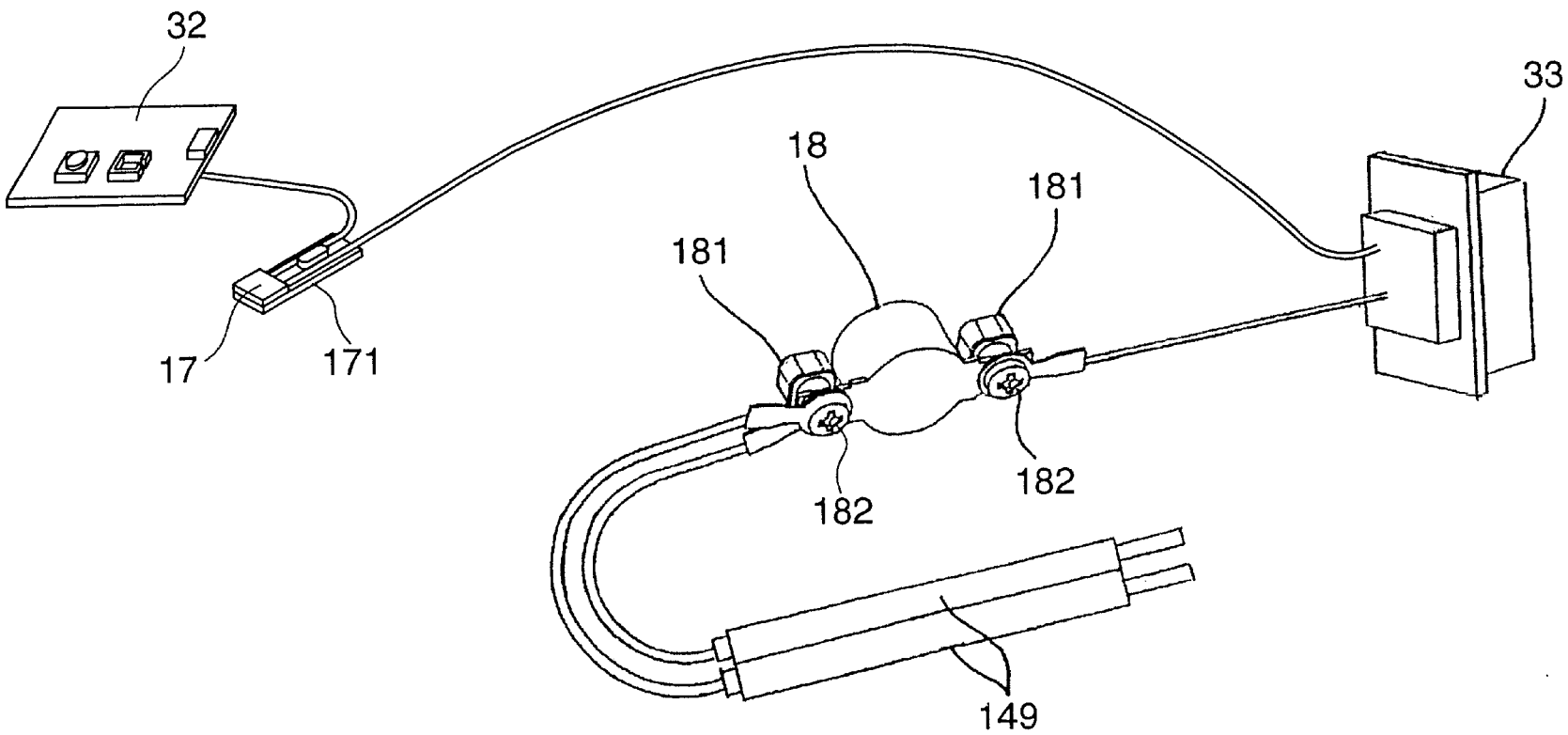
FIG. 16 is a conceptual diagram of an electrical system provided in the fixing device.

FIG. 16 is a conceptual diagram of an electrical system provided in the fixing device 8.

As shown in FIG. 16, the thermistor 17 and the thermostat 18 are provided as temperature control sensors in this fixing device 8. The thermistor 17 is arranged such that it comes into contact with the heating roller 14 under slight pressure and detects the surface temperature of the heating roller 14, outputting a detection signal to a control section provided in the main body of the image forming apparatus 1 by means of a temperature circuit board 32 and a connector 33 attached to the rear portion of the fixing device 8. The thermostat 18 is arranged on the power line supplying electrical power to the heater 149 from the control section of the main body of the image forming apparatus 1 in the vicinity of the heating roller 14, and it cuts off the power supply to the heater 149 when the heater 149 is too hot.

As shown in FIG. 7 and FIG. 11, a sensor mounting rib 252 is provided in the inside surface of the first casing 25 in the vicinity of the heating roller 14, extending in the longitudinal direction of the heating roller 14. The thermistor 17 is attached to the vicinity of the front end portion of the sensor mounting rib 252 and the thermostat 18 is mounted in the central region of the sensor mounting rib 252. The temperature circuit board 32 is mounted on the front of the first casing 25 and the heater 149 is mounted inside the heating roller 14 supported by the first casing 25.

The sensor mounting rib 252 demarcates the rear side space in which the heating roller 14 is arranged inside the fixing device 8, and it functions as a thermal shield which shields this rear side space from the heat of the heating roller 14. This rear side space is used as a wiring section 36 for providing wiring connections from the connector 33 to the heater 149, thermistor 17, thermostat 18, temperature circuit board 32, and the like. In FIG. 11, wiring connections to the heater 149, thermistor 17, thermostat 18, temperature circuit board 32, and the like, are partially omitted from the diagram.

Figure 17:
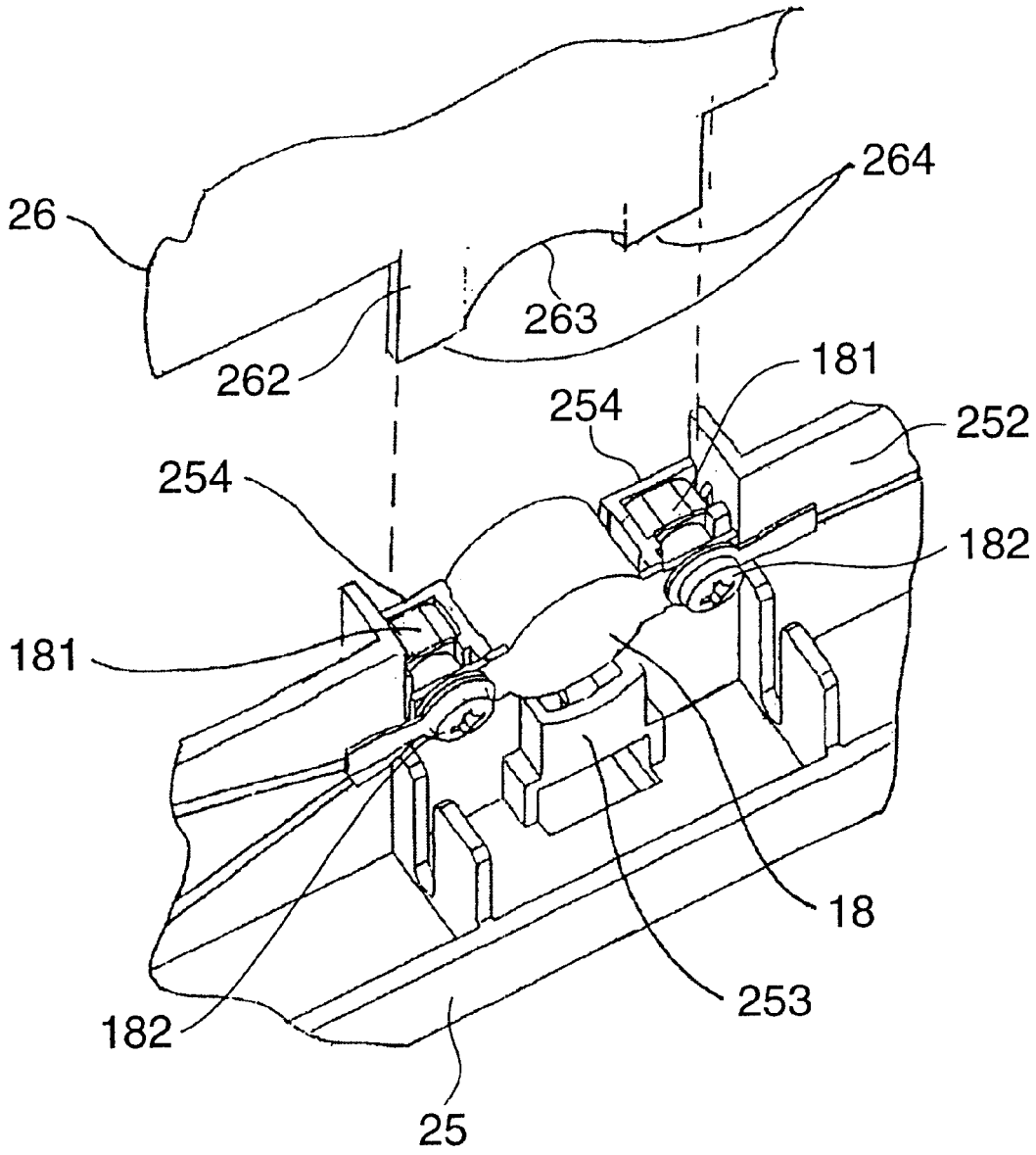
FIG. 17 is a perspective explanatory diagram of a portion wherein a thermostat is mounted.

FIG. 17 is a perspective explanatory diagram of the mount section of the thermostat 18. As shown in the diagram, the thermostat 18 is of a type in which the electric wires are connected by screws 182, nuts for tightening these screws 182 being provided on each side of the thermostat 18 as square-shaped fastening tools 181. A thermostat mounting section 253 having the same radius shape as the external form of the thermostat 18, and square hole-shaped recesses 254 formed on each side of the thermostat 18 are provided in the sensor mounting rib 252 of the first casing 25. The thermostat 18 is mounted on the thermostat mounting section 253 and is held on the first casing 25 by fitting the fastening tools 181 on each side thereof respectively into the recesses 254.

A sensor pressing rib 262 is also arranged in the second casing 26, for pressing and securing the thermostat 18 held in the first casing 25, on the upper face thereof. This sensor pressing rib 262 comprises a thermostat pressing section 263 having the same radius shape as the outer form of the thermostat, and fastening tool pressing sections 264 which presses on the upper face of the fastening tools 181.

Conventionally, various types of mounting structure have been proposed for a thermostat, which is provided in order to prevent overheating of the heating roller in the fixing device; Japanese Unexamined Utility Model No. (Hei)6-37855 discloses a construction wherein a holding member is provided for mounting a thermostat at a predetermined distance from the heating roller, and Japanese Unexamined Patent Publication No. 2000-356920 proposes a construction wherein metallic thermostat fastening tools are inserted into a resin holding member, and a thermostat is mounted at a predetermined distance from the heating roller, by attaching it to these fastening tools. However, in the former construction, it is necessary to provide a holding member for securing the thermostat, this holding member must be mounted inside the cover section, and hence the cover must be removed when performing replacement or cleaning tasks, of the like. Moreover, in the latter construction, special holding members are required for the thermostat. Furthermore, in these devices, the thermostat connection wires are on the outer side of the cover and hence a member for supporting these is also required. In addition, when assembling the thermostat and heating roller, it is difficult to perform accurate assembly since the state of proximity therebetween cannot be observed.

In view of the foregoing, by means of the construction relating to the present invention, the thermostat 18 is secured by being held between the sensor mounting rib 252 in the first casing 25 and the sensor pressing rib 262 in the second casing 26, and hence the thermostat 18 can be assembled in a simple manner, without requiring special fastening tools.

During assembly of the thermostat 18, after mounting the fixing roller unit inside the first casing 25, the distance between the thermostat 18 and the heating roller 14 can be confirmed from the upper face of the first casing 25, and hence the thermostat 18 is able to operate with good accuracy, and the quality of the assembly operation can be readily confirmed.

In the mounting construction for the thermostat 18, even if the thermostat 18 is assembled with the sensor mounting rib 252 after attaching the fastening tools 181 thereto, the thermostat 18 can be secured to these fastening tools 181 by the screws 182 after fitting the fastening tools 181 into the sensor mounting rib 252, and hence the construction permits flexibility with respect to the assembly operation environment.

Figure 18:
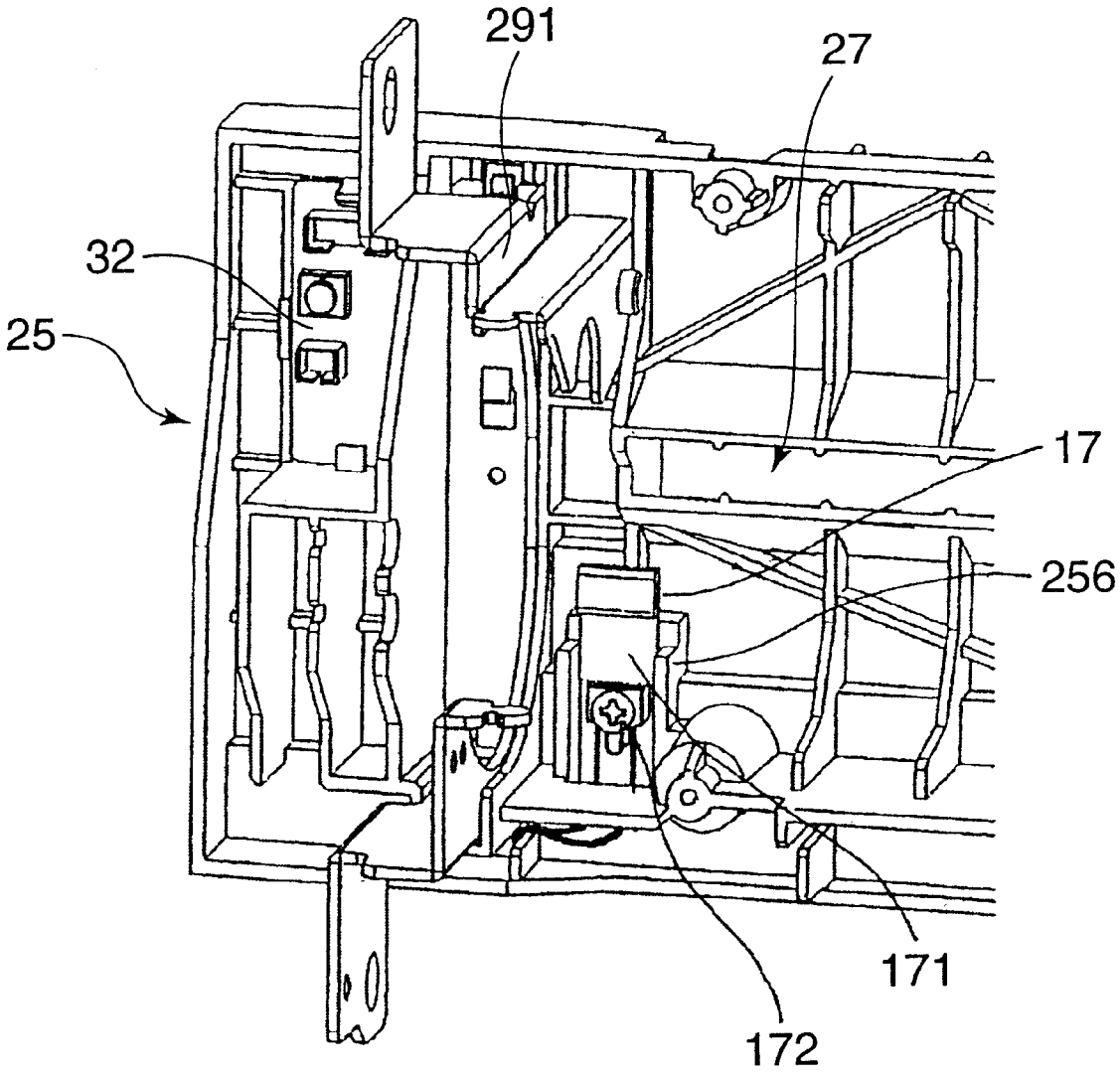
FIG. 18 is a perspective diagram of a portion wherein a thermistor is mounted.

FIG. 18 is a perspective view of the mount section for the thermistor 17. As shown in FIG. 18, the thermistor 17 is attached to the front end of an elastic member 171 in which an mounting hole for a screw 172 is formed. A square hole 255 for inserting the thermistor 17 from the side of the wiring section 36 is formed in the sensor mounting rib 252 of the first casing 25 (see FIG. 8), and a thermistor mounting section 256 for supporting the lower surface and either side of the elastic member 171 is provided on the inner side of this square hole 255. The thermistor 17 is introduced via the square hole 255 and, with the elastic member 171 being mounted in the thermistor mounting section 256, it is attached in a predetermined position by the screw 172.

In conventional fixing devices, various mounting structures have been proposed for thermistors which detect temperature by making light contact with the heating roller, in order to control the temperature of the heating roller; Japanese Unexamined Utility Model Publication No. (Hei) 1-73865 discloses a construction where a thermistor is mounted on a floor plate which forms the fixing unit holding member, by means of a spring member, and Japanese Patent No. 2968345 discloses a construction wherein an mounting hole is provided in a cover which covers the heating roller, the thermistor is held on the cover by mounting the thermistor into the mounting hole from the outer side of the cover, and lead wires are connected to a temperature control section located outside the cover.

However, in the former construction, since the thermistor is mounted by a spring member to the floor plate forming the holding member of the fixing unit, the state of contact between the thermistor and the heating roller cannot be confirmed, and what is more, the cover must be removed when performing replacement or cleaning tasks, or the like. Furthermore, in the latter construction, since the thermistor is introduced into the mounting hole from the outer side of the cover, although it is simple to replace, it is not possible to confirm whether or not it is making reliable contact with the heating roller.

In view of the foregoing, according to the construction in accordance with the present invention as described above, since the thermistor 17 can be mounted from the upper side of the first casing 25, similarly to the thermostat 18, then the thermostat 18 can be assembled in a simple fashion.

During assembly of the thermistor 17, the state of contact between the thermistor 17 and the heating roller 14 can be confirmed from the upper face of the first casing 25, and hence the thermistor 17 can be made to operate with good accuracy and the quality of the assembly operation can also be confirmed readily.

Furthermore, since a linear-shaped thermistor 17 is used, variation in the contact pressure with the heating roller 14 is restricted and stable performance can be achieved.

Moreover, since the wiring connections to the heater, connector, thermistor, and the like are arranged in the wiring section 36 formed in the first casing 25, it is possible to confirm the wiring status of each wire while assembling the respective constituent parts.

Next, a mounting structure of the connector 33 on the fixing device 8 is described. FIG. 19 is a perspective diagram of the rear side portion of the fixing device 8.

As shown in FIG. 19, the connector 33 for electrically connecting the fixing device 8 to a connector (not illustrated) provided in the main body of the image forming apparatus 1 is mounted in the rear portion of the fixing device 8, and the connector 33 projects rearwards from the casings 25 and 26. Furthermore, in the portions of the first casing 25 and the second casing 26 contacting the connector 33, there are formed cutaway sections 257, 267 which match the external shape of the connector 33, the connector 33 being assembled in the housing being mounted in these cutaway sections 257, 267, and held respectively from above and below by the first casing 25 and the second casing 26.

Figure 20:
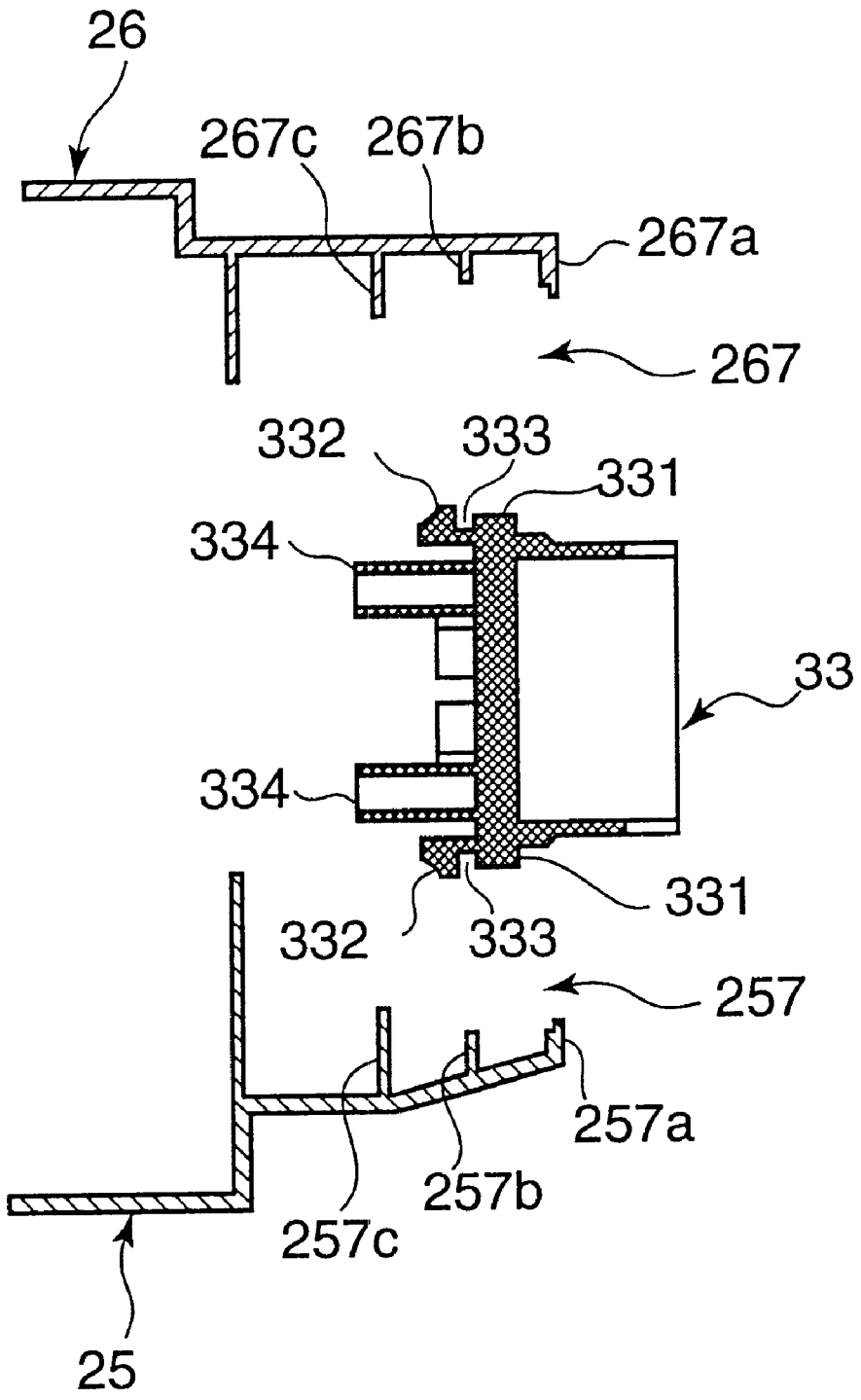
FIG. 20 is a sectional diagram showing a state wherein a mount section for a connector is dismounted.

FIG. 20 is a sectional view showing a disassembled state of the mount section for the connector 33. As shown in FIG. 20, as a supporting section for the connector 33, there are provided in the first casing 25 and the second casing 26: side wall sections 257*a*, 267*a*, first support sections 257*b*, 267*b*, and second support section 257*c*, 267*c*, in which the cutaway sections 257, 267 are formed.

Figure 21:
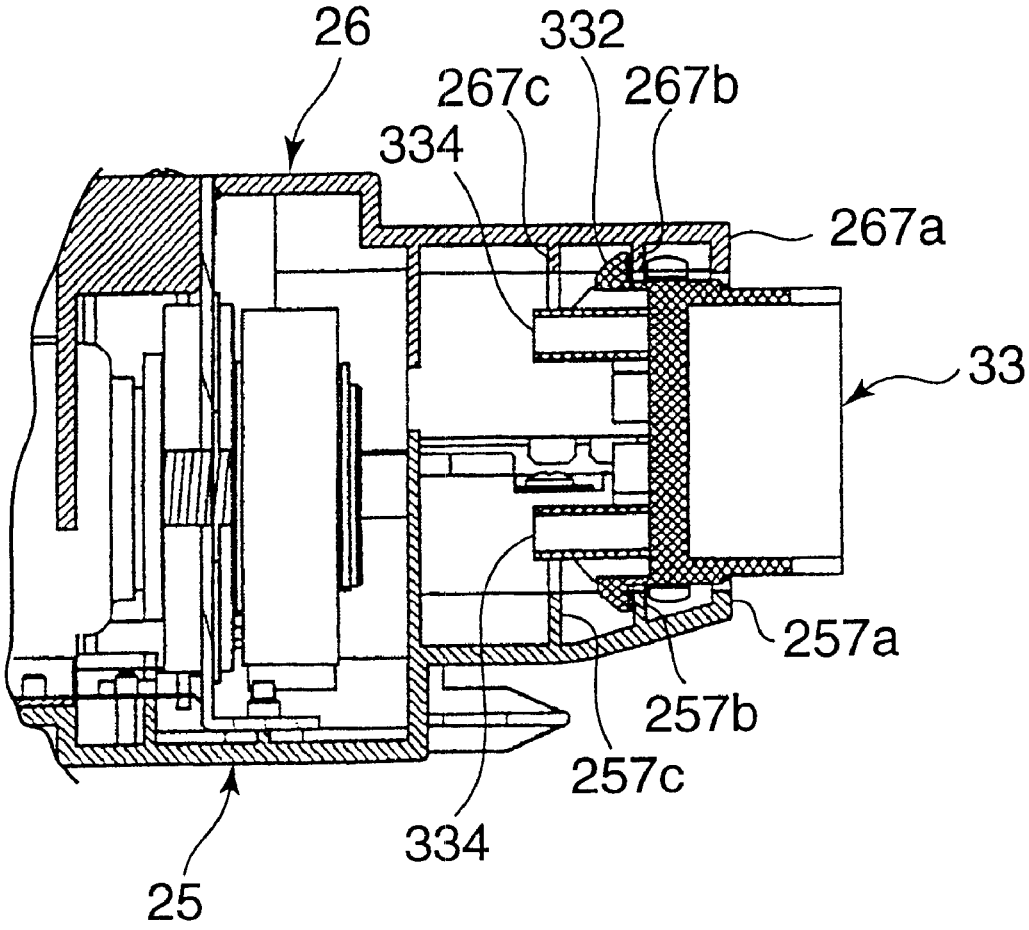
FIG. 21 is a sectional diagram showing a state wherein a connector is mounted.

FIG. 21 is a sectional view showing the connector 33 in an assembled state. As shown in FIG. 21, after assembly of the housing, the connector 33 is supported in directions orthogonal to the direction in which the fixing device 8 is introduced and withdrawn from the main body of the image forming apparatus 1, by means of the side wall sections 257*a*, 267*a*, first support sections 257*b*, 267*b*, and second support section 257*c*, 267*c*.

The cutaway sections 257, 267 of the side wall sections 257*a*, 267*a* of the first casing 25 and the second casing 26 are formed slightly larger than the external form of the connector 33 such that they are able to absorb any divergence or error in the orthogonal directions to the direction of coupling of the two connectors when the connector 33 is connected to or removed from the connector in the main body of the image forming apparatus 1.

Recesses 333 into which the first supporting section 257*b* and 267*b* fit as projecting sections are formed in the connector 33 in the portions of the housing corresponding to the first support sections 257*b,* 267*b* between projecting sections 331, 332 such that the movement of the connector 33 with respect to the housing is restricted in the direction in which the fixing device 8 is introduced and withdrawn with respect to the main body of the image forming apparatus 1.

The shape of the recess 333 is a slightly larger shape than that of the first supporting sections 257*b,* 267*b* in the direction of introduction and withdrawal of the fixing device 8, for example, substantially 0.5 mm larger, such that it absorbs any positional divergence or error between the two connectors in the coupling direction thereof when the connector 33 is coupled or uncoupled with respect to the connector in the main body of the image forming apparatus 1.

The second supporting sections 257*c,* 267*c* formed in the first casing 25 and the second casing 26 contact projecting sections 334 formed on the connector 33 such that the connector 33 is held in directions orthogonal to the direction in which the fixing device 8 is introduced and withdrawn with respect to the main body of the image forming apparatus 1.

Figure 22:
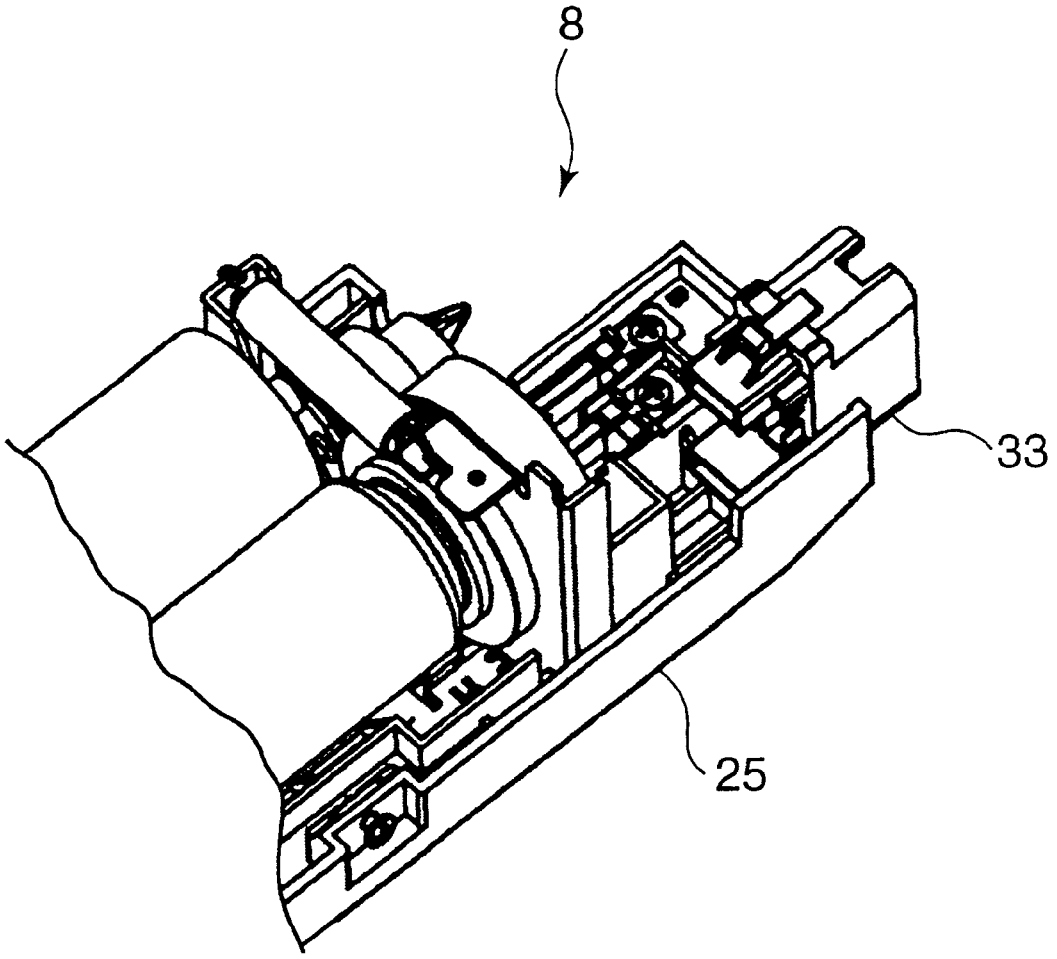
FIG. 22 is a perspective diagram showing a state wherein a connector is mounted on the first casing.

FIG. 22 is a perspective diagram showing a state where the connector 33 is mounted on the first casing 25 at an intermediate stage of the assembly of the fixing device 8. As shown in FIG. 22, initially, the connector 33 is fitted into the cutaway section 257 of the first casing 25 and provisionally held on the first casing 25 in which state the second casing 26 is placed thereon, thus assembling the connector 33 with the housing.

Figure 36A:
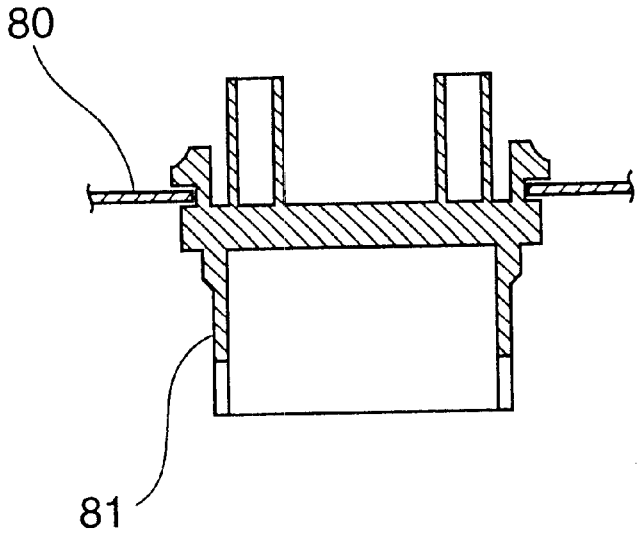
FIG.36A PRIOR ART
FIGS. 36A and 36B are sectional views showing a conventional structure of a conventional connector.
Figure 36B:
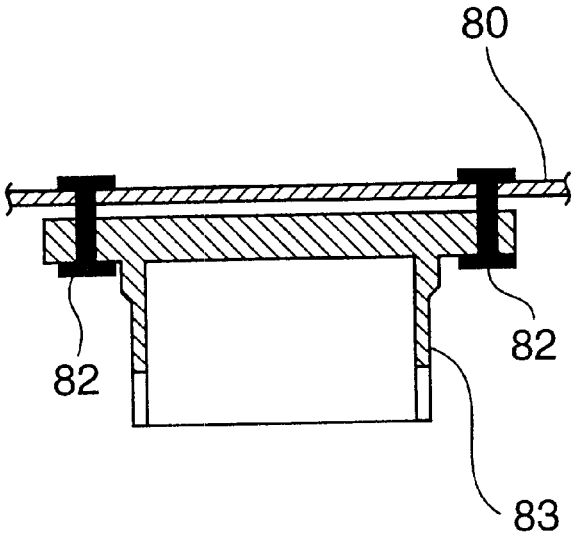
FIG.36B PRIOR ART

Conventional removable units for image forming apparatus, and the like, have connector mounting constructions for obtaining electrical connection with the main body of the device which involve, for example, push-fitting a connector 81 into an opening section formed in the side wall 80 of the unit housing, as illustrated in FIG. 36A, or fixing a connector 83 to the side wall 80 of the unit housing, by means of pins, screws 82, or the like, as illustrated in FIG. 36B.

However, in the construction in FIG. 36A, since a large pressure is applied to the side wall 80 of the housing when the connector 81 is fitted thereinto, there is a risk that a housing made from synthetic resin, or the like, will be damaged, and therefore the housing must be made from steel plate, or the like, having a high strength. Moreover, in the construction in FIG. 36B, fixing components, such as pins, screws 82, or the like, are required, thereby increasing the number of parts and hence complicating the assembly process.

In view of the foregoing, according to the construction in accordance with the present invention as described above, since the connector 33 is mounted by being held between the first casing 25 and the second casing 26, there is no increase in the number of parts, and the cases can be made from synthetic resin, or the like, which has an inferior strength to steel plate, or the like.

Moreover, since the connector 33, and almost all the other constituents parts to be accommodated inside the fixing device 8, such as the fixing roller unit, thermistor 17, thermostat 18, and the like, are supported by the first casing 25, the assembly of the fixing device 8 can be performed in a simple fashion.

Next, the construction for achieving positional registration when the fixing device 8 is mounted in the main body of the image forming apparatus 1 will be described. As shown in FIG. 3, an insertion rail section 46 is formed on the underside of the first casing 25, parallel to the direction in which the fixing device 8 is mounted and withdrawn with respect to the main body of the image forming apparatus 1. This insertion rail section 46 is guided by a guide rail (not illustrated) provided on the main body of the image forming apparatus 1 such that the fixing device 8 is inserted smoothly into the main body of the image forming apparatus 1.

A stopper projection 35 projecting in a lateral direction is provided on the side portion of the front (right-hand side in FIG. 3) of the first casing 25 such that it abuts on a stopper receiving section (not illustrated) provided on the main body of the image forming apparatus 1 thereby preventing the fixing device 8 from being inserted too far into the main body of the image forming apparatus 1.

As shown in FIG. 19, the first casing 25 is provided with two positioning projections 31 on the rear face of the fixing device 8 which regulate the position of the fixing device 8 with respect to the main body of the image forming apparatus 1 when the fixing device 8 is mounted therein.

These two positioning projections 31 project in a parallel plane to the plane containing the rotational axes of the heating roller 14 and the pressing roller 15, in parallel with the axial direction of the two rollers 14, 15, and at a distance apart that exceeds the distance between the axes of the two rollers 14, 15.

The two positioning projections 31 are provided in an area outside the high-temperature region of the first casing that corresponds to a radial section of the heating roller 14 or is equivalent of an projected image of the heating roller 14 in the axial direction of the heating roller 14.

Furthermore, the two positioning projections 31 are provided on the inner sides of the frame bend sections 307, 308 whereby the rear frame 30 is supported on the first casing 25, in the vicinity of the rear frame 301 which supports the heating roller 14 and pressing roller 15 in their predetermined positions.

Figure 23:
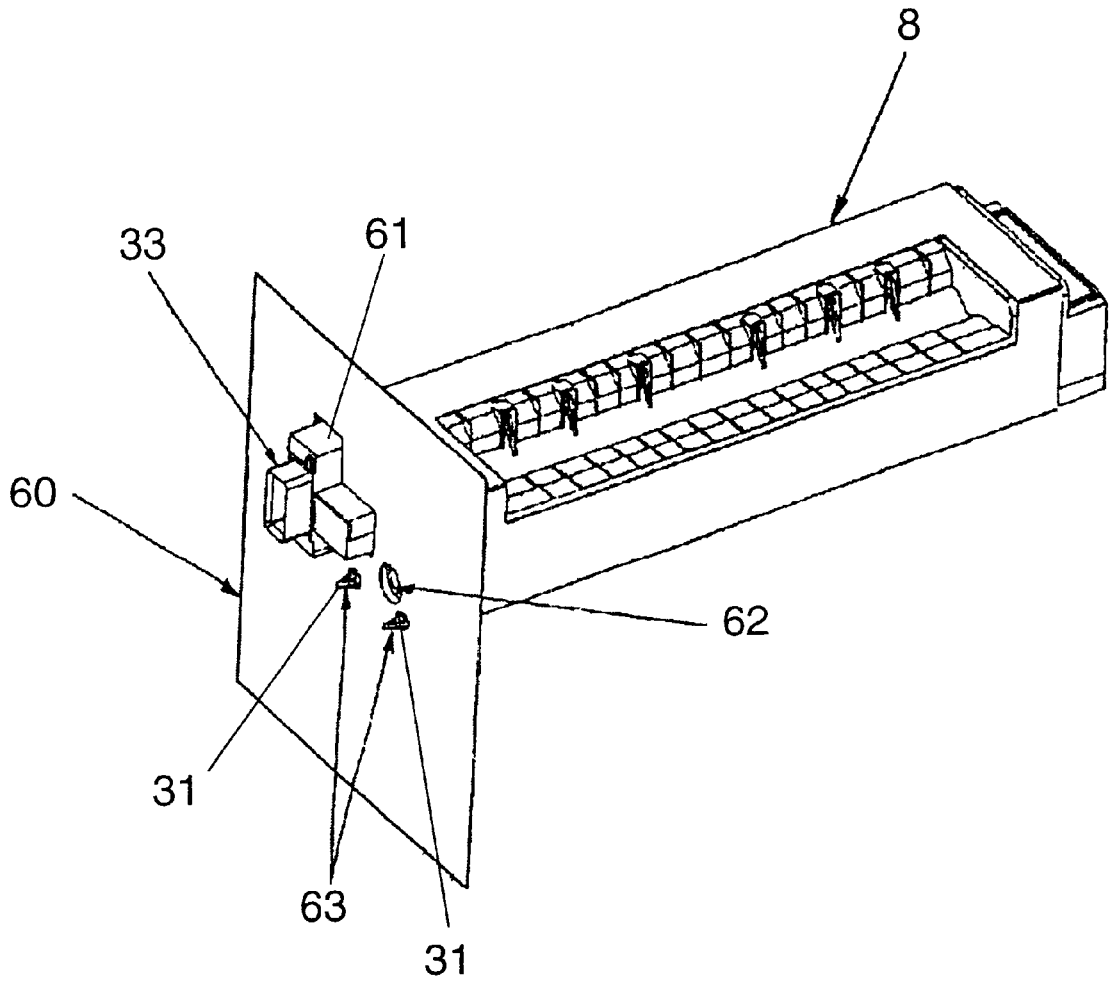
FIG. 23 is a perspective diagram schematically showing a state wherein the fixing device is mounted in a main body of the image forming apparatus.

FIG. 23 is an explanatory diagram showing a conceptual view of a state where the fixing device 8 is mounted in the main body of the image forming apparatus 1.

As shown in FIG. 23, when the fixing device 8 is mounted in the main body of the image forming apparatus 1, the connector 33 projects from a connector receiving hole 61 formed in the rear side plate 60 of the main body of the image forming apparatus 1, and by coupling the connector 33 with a connector (not illustrated) provided in the main body of the image forming apparatus 1, electric power is supplied from the main body of the image forming apparatus 1 to the fixing device 8 and temperature information and control signals are exchanged therebetween.

A drive gear 34 provided on the rear face of the fixing device 8 projects at the position of a drive gear receiving hole 62 formed in the rear side plate 60, and by meshing with a drive transmission gear (not illustrated) provided in the main body of the image forming apparatus 1, drive power is transmitted to the fixing device 8 from the main body of the image forming apparatus 1.

Positioning holes 63 formed in the rear side plate 60 engage with the positioning projections 31 on the fixing device 8, thereby positioning the fixing device 8 with respect to the main body of the image forming apparatus 1.

In this manner, since the two positioning projections 31 for registering the position of (i.e., positioning) the fixing device 8 with respect to the main body of the image forming apparatus 1 are provided on the first casing 25 which supports both the heating roller 14 and the pressing roller 15, then it is possible to obtain high positional accuracy for both rollers 14, 15 with respect to the main body of the image forming apparatus 1 by utilizing the strength of the first casing 25.

Since the two positioning projections 31 project in a parallel plane to the plane containing the rotational axes of the rollers 14, 15, in parallel with the axial direction of the two rollers 14, 15, and at a distance apart that exceeds the distance between the axes of the two rollers 14, 15, then high positional stability of the two positioning projections 31 with respect to the two rollers 14, 15 is obtained. Furthermore, good positioning accuracy can be obtained for the two rollers 14, 15 with respect to the main body of the image forming apparatus 1.

The two positioning projections 31 are arranged in positions outside the high-temperature region which projects from the inner region of the heating roller 14 in the axial direction of the heating roller 14. As such, distortion and the like due to the heat of the heating roller 14 is restricted. Therefore, even if the first casing 25 is made from a resin material, warping or twisting due to heat during sustained periods of use is not liable to occur, and good positional accuracy can be obtained for the two rollers 14, 15 with respect to the main body of the image forming apparatus 1.

In addition, since the two positioning projections 31 project on the inner side of the frame bend sections 307, 308 of the rear frame 301, the positional accuracy of the two positioning projections 31 is ensured by the rigidity of the rear frame 301, and in this respect also, high positional accuracy can be obtained for the two rollers 14, 15 with respect to the main body of the image forming apparatus 1.

Also, since the positioning projections 31 project only a small distance rearwards beyond the connector 33, they are not liable to cause an obstacle when the fixing device 8 is removed from the image forming apparatus 1, and they are also prevented from knocking against and being deformed by another object, and hence in this respect also, high positional accuracy can be obtained for the two rollers 14, 15 with respect to the main body of the image forming apparatus 1.

In order to prevent electrostatic damage to the two rollers 14, 15, desirably, at least one portion of the positioning projections 31 or stopper projections 35 should be constituted by a metal section that is connected to the front frame 291 and the rear frame 301, and is also earthed to the conducting section of the main body of the image forming apparatus 1.

Next, the separating members 16, 50 provided in order to prevent the recording paper from winding around the heating roller 14 and pressing roller 15 will be described.

Figure 24:
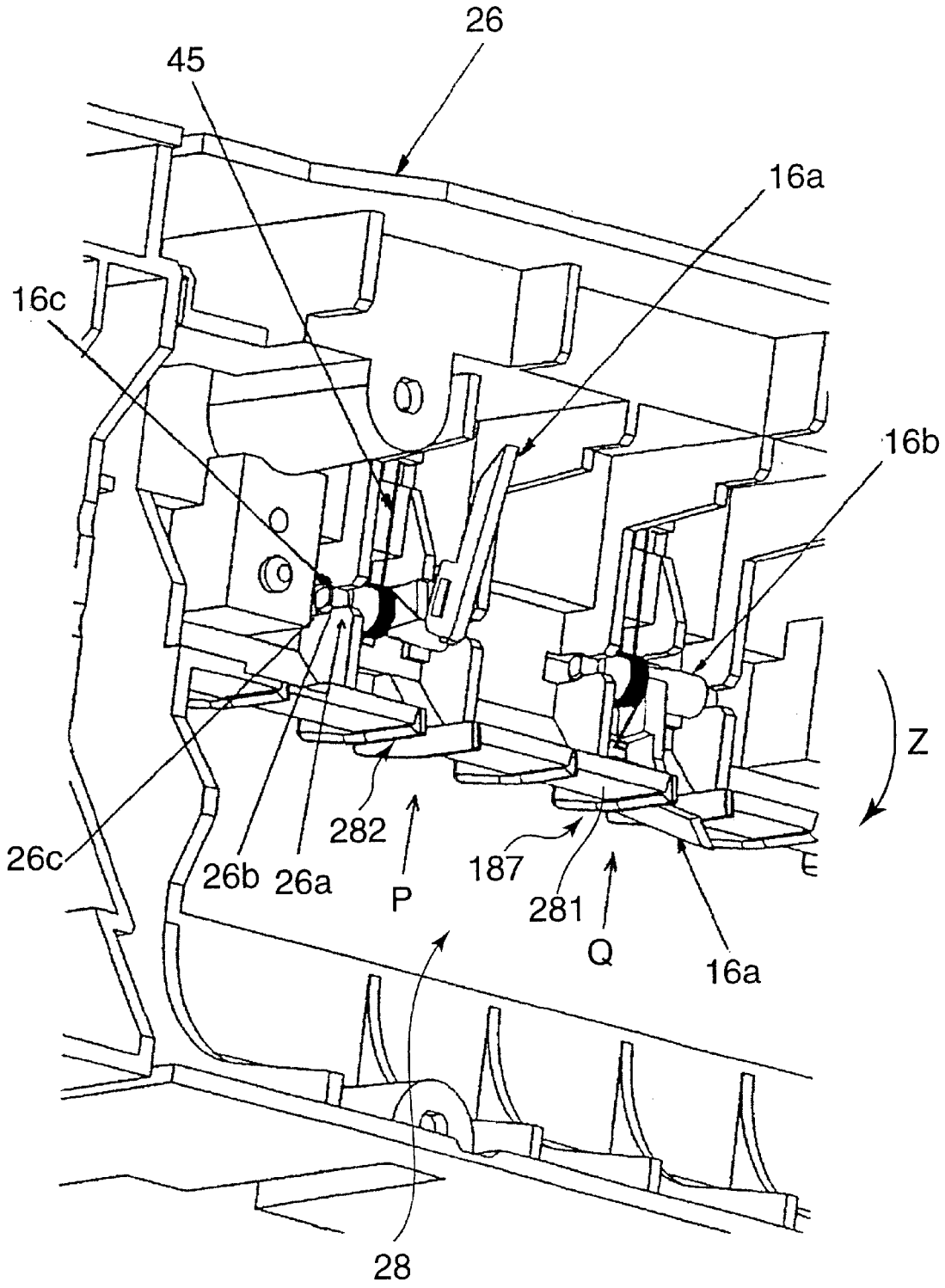
FIG. 24 is a perspective diagram showing a portion in which a separating member is arranged, being viewed from inside of the second casing.

Initially, the separating members 16 mounted in the second casing 26 in order to prevent recording paper from winding around the heating roller 14 will be described. FIG. 24 is a perspective diagram of the section wherein the separating members 16 are mounted, as viewed from the inside of the second casing 26.

As shown in FIG. 24, each separating member 16 is an approximate L-shaped member in side view, and is formed with a claw 16*a* at the front end thereof, which comes into contact with the heating roller 14 and separates the recording paper from the heating roller 14, and a rotating axle 16*b* projecting to each side of the claw 16*a* formed at the other end thereof. The two side portions 16*c* of the rotating axle 16*b* are formed with a non-circular cross-section, more specifically, an oval shape (similar to the shape of an athletics track) formed by linearly truncating either side of a circular shape.

This separating member 16 is attached to the inside surface of the second casing 26 such that it faces the outlet opening section 28 of the second casing 26. FIG. 24 illustrates the mounting position of left-hand side separating member 16 indicated by the arrow P when it is mounted on the second casing 26. On the other hand, the right-hand side separating member 16 indicated by the arrow Q is shown in a separating operation position adopted when it is separating the recording paper from the heating roller 14. Cutaway sections 282 are provided on the guide surface 281 which guide the conveyance of the recording paper in the outlet opening section 28 in order that the claw 16*a* of the separating member 16 in the position shown by arrow Q can project into the outlet opening section 28.

A bearing rib 26*a* supporting each end of the rotating axle 16*b* is provided on the inside surface of the second casing 26, on each side of the separating member 16. Slit sections having an opening for inserting the rotation axle end sections 16*c* of the separating members 16 are provided in these bearing ribs 26*a*, these slit sections being formed such that the width of the lower slit 26*c* on the base-side is greater than that of the upper slit 26*b* on the opening side.

A spring 45 is provided between the separating member 16 attached on the bearing ribs 26*a* of the second casing 26, to form an urging or biasing member for pressing the separating member 16 in the rotational direction whereby the claw 16*a* of the separating member 16 abuts on the heating roller 14 (a direction whereby the separating member 16 rotates from position Q to position P in FIG. 24).

Figure 25A:
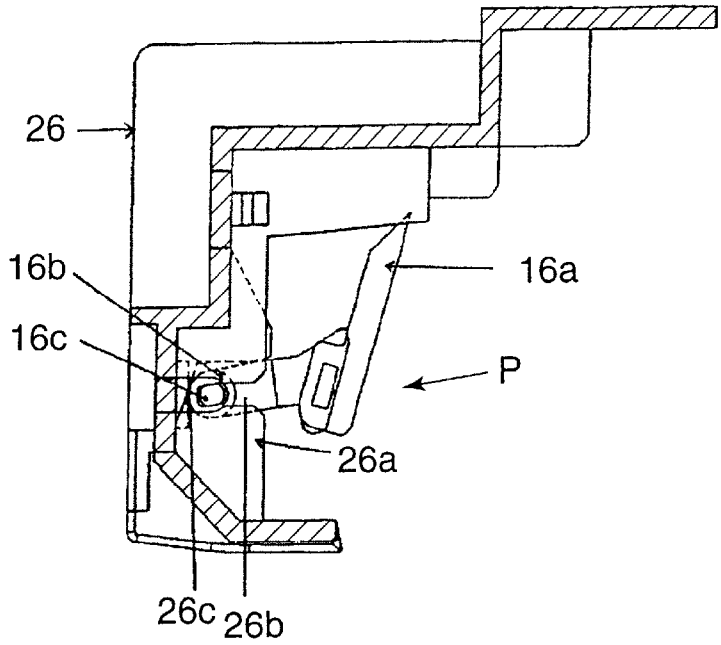
FIG. 25A is a lateral sectional view of the second casing wherein the separating member is mounted in the mounting position shown in FIG. 24.
Figure 25B:
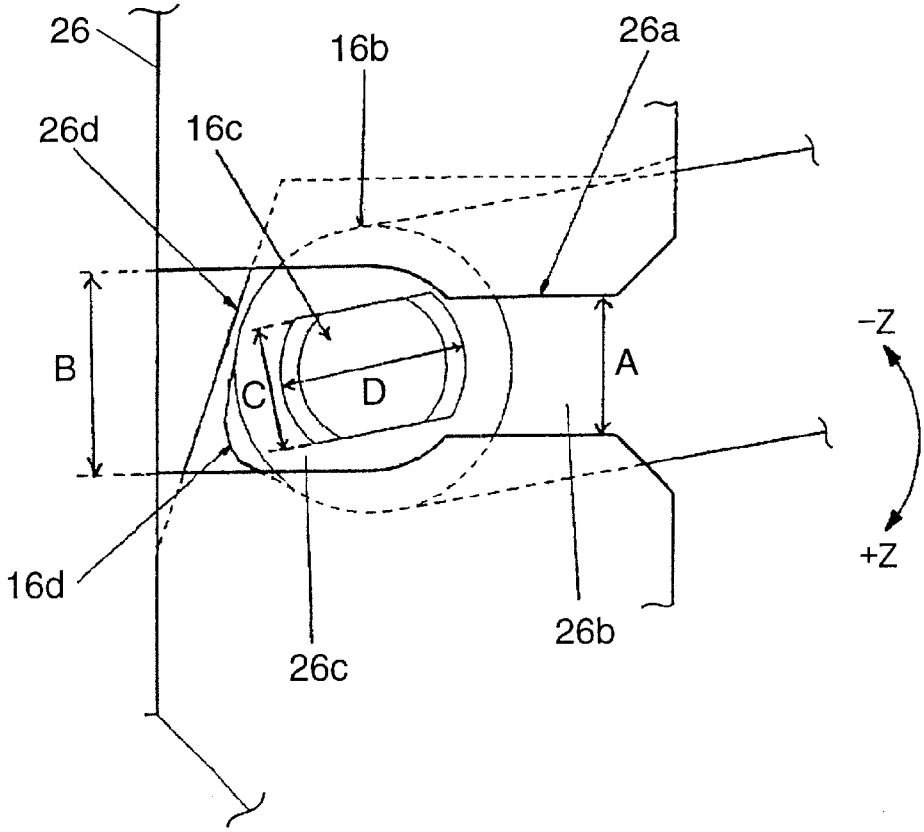
FIG. 25B is an enlarged sectional view of the region of a rotational axis of the separating member in the position shown in FIG. 25A.

FIG. 25A is a lateral sectional view showing the mounting position of the separating member 16 (position P in FIG. 24) when mounted on the second casing 26, and FIG. 25B is an enlarged sectional view of the vicinity of the rotational axle in position P. As seen in FIG. 25B, the end sections 16*c* of the rotational axle 16 are substantially oval-shaped with opposed arcuate portions and opposed flat portions.

As shown in FIG. 25B, the relationship between the axial diameter of the two end sections 16*c* of the rotating axle 16*b* and the slit width of the bearing rib 26*a* is such that, taking the width of the upper slit 26*b* as A, the width of the lower slit 26*c* as B, the shortest diameter of the rotating axle end sections 16*c* as C (which is also the distance between the opposed flat portions), and the longest diameter of the rotating axle end sections 16*c* as D (which is also the distance between the opposed arcuate sections), the relationship $C<A<D<B$ is satisfied.

As such, in the mounting position P shown in FIG. 24A, the shortest diameter C of the rotating axle end section 16*c* passes through the upper slit 26*b* and the separating member 16 is inserted up to the lower slit 26*c*.

A projecting section 16*d* having a curved end is formed in substantially the central portion of the rotating axle 16*b* in the lateral direction thereof, projecting in an orthogonal direction to the axial direction of the rotating axle. Furthermore, in the second casing 26, a restricting rib 26*d* having a section that is positioned a slightly shorter distance from the rotating axle 16*b* than the height of the end of the projecting section 16*d* above the rotating axle 16*b* is provided in a position corresponding to the projecting section 16*d*.

Figure 26A:
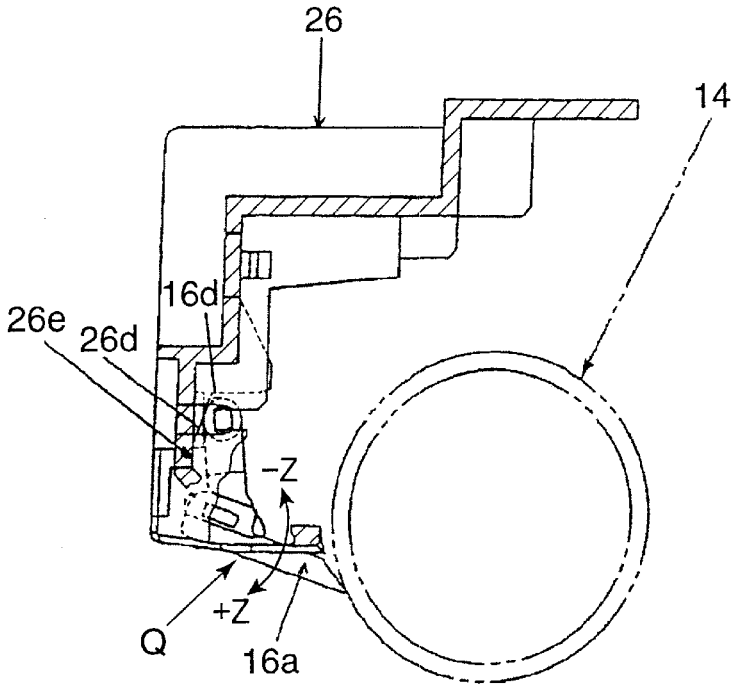
FIG. 26A is a lateral sectional view of the second casing wherein the separating member is in the separating operation position shown in FIG. 24 in which it separates recording paper from the heating roller.
Figure 26B:
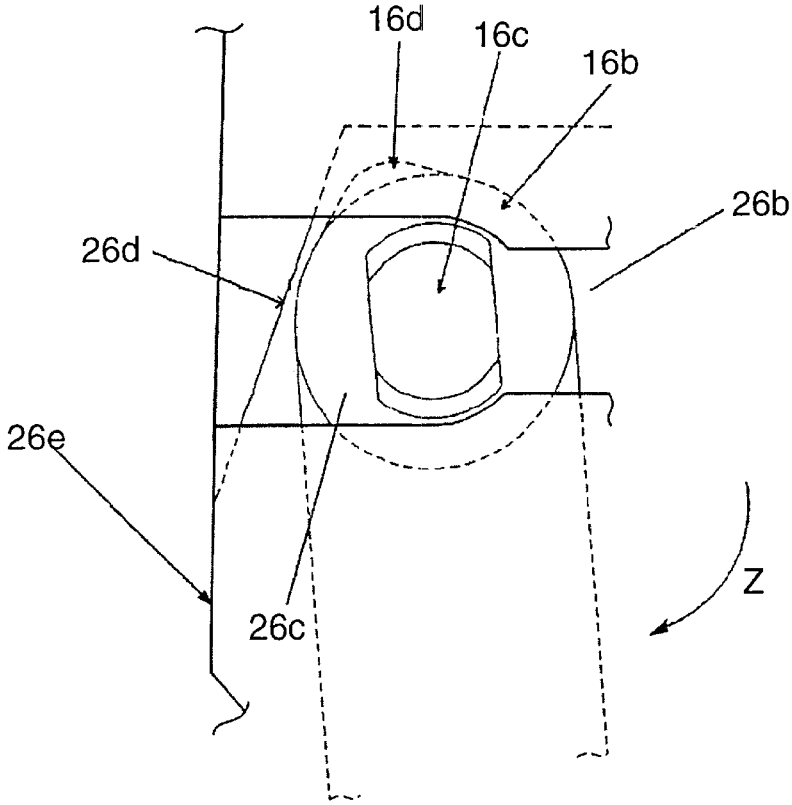
FIG. 26B is an enlarged sectional diagram of the region of the rotational axis of the separating member in the position shown in FIG. 26A.

FIG. 26A is a lateral sectional view of the separating member 16 in a separating operation position for separating recording paper from the heating roller (position Q in FIG. 24), and FIG. 26B is an enlarged sectional view of the vicinity of the rotating axle in position Q.

The separating member 16 of which the rotating axle end sections 16*c* are inserted into the lower slits 26*c* in the mounting position P illustrated in FIG. 25A is then turned by an operator, or the like, in the direction of arrow Z whereby the claw 16*a* approaches the outlet opening section 28, and the separating member 16 assumes the separating operation position Q illustrated in FIG. 26A.

In this case, the rotating axle end sections 16*c* of the separating member 16 are inserted in the lower slits 26*c* due to the fact that the longer diameter D is wider than the upper slits 26*b,* and hence it cannot fall out via the upper slits 26*b.*

As shown in FIG. 25B and FIG. 26B, when the separating member 16 is rotated from the mounting position P to the separating operation position Q, the aforementioned projecting section 16*d* rides up on the restricting rib 26*d.*

In this separating operation position, the separating member 16 is pressed in a rotational direction to abut on the heating roller 14 (direction -Z in FIG. 26A), by means of the spring 45, as described above, but even if it is not in contact with the heating roller 14, since the projecting section 16*d* of the separating member 16 is restricted by the restricting rib 26*d,* the separating member 16 will not return from the separating operation position Q to the mounting position P in view of the urging or biasing force of the spring 45.

In the prior art, several constructions are proposed for mounting a separating hook for separating the recording paper from the fixing roller onto a guide member for guiding the conveyance of the recording paper, (see Japanese Patent No. 2960738, Japanese Utility Model No. 2599173), but they require a large number of parts and are complicated to assemble.

In view of the foregoing, according to the construction in accordance with the present invention as described above, it is possible to achieve a structure for separating recording paper that has adhered to the heating roller 14 by means of only three elements, namely, a second casing 26 whereon bearing ribs, and the like, are formed integrally in the heat-resistant resin, a separating member 16, and a spring 45, and hence the number of parts can be reduced significantly in comparison with a conventional structure.

Next, a separating member 50 for preventing recording paper from winding about the pressing roller 15 is described.

In the image forming apparatus 1, the double-side conveyance path 13 can be exposed externally by adopting a unit wherein the side cover 131 can be open and shut in order to deal with paper jams, or the like, in the double-side conveyance path 13 (see FIG. 1).

Figure 27:
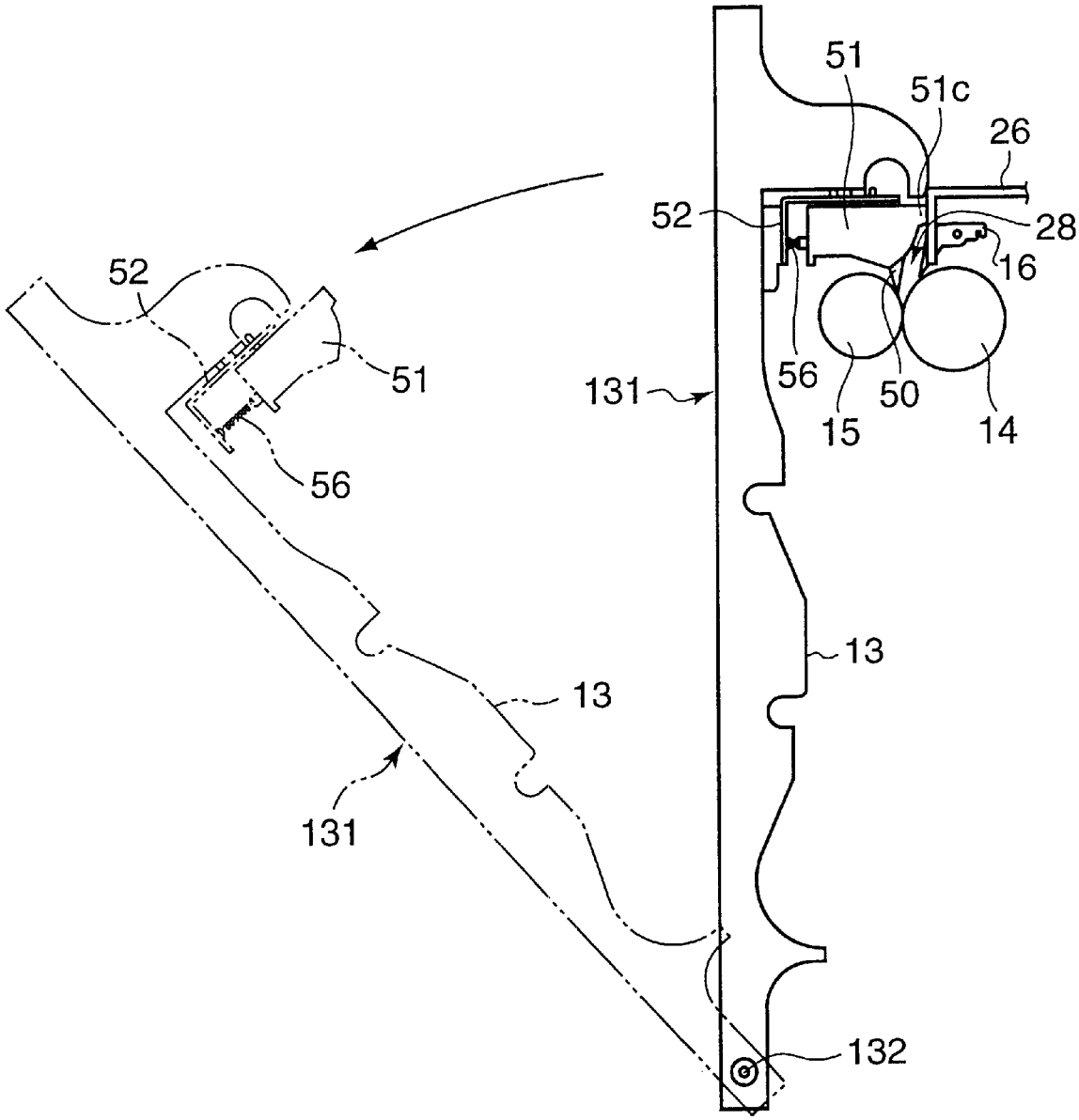
FIG. 27 is a front view illustrating opening and closing operation of a side cover which opens and closes a double-side conveyance path.

FIG. 27 is a front view which illustrates the opening and closing action of the side cover 131 which opens and shuts the double-side conveyance path 13.

As illustrated in FIG. 27, the side cover 131 rotates about a rotational support axle 132, and a guide member 51 for guiding the conveyance of the recording paper outputted from the outlet opening section 28 is mounted on the upper portion thereof, in a position facing the outlet opening section 28 of the fixing device 8. A separating member 50 for preventing recording paper from winding around the pressing roller 15 is attached to the guide member 51. The guide member 51 is made of a synthetic resin, or the like, having low thermal conductivity.

Figure 28:
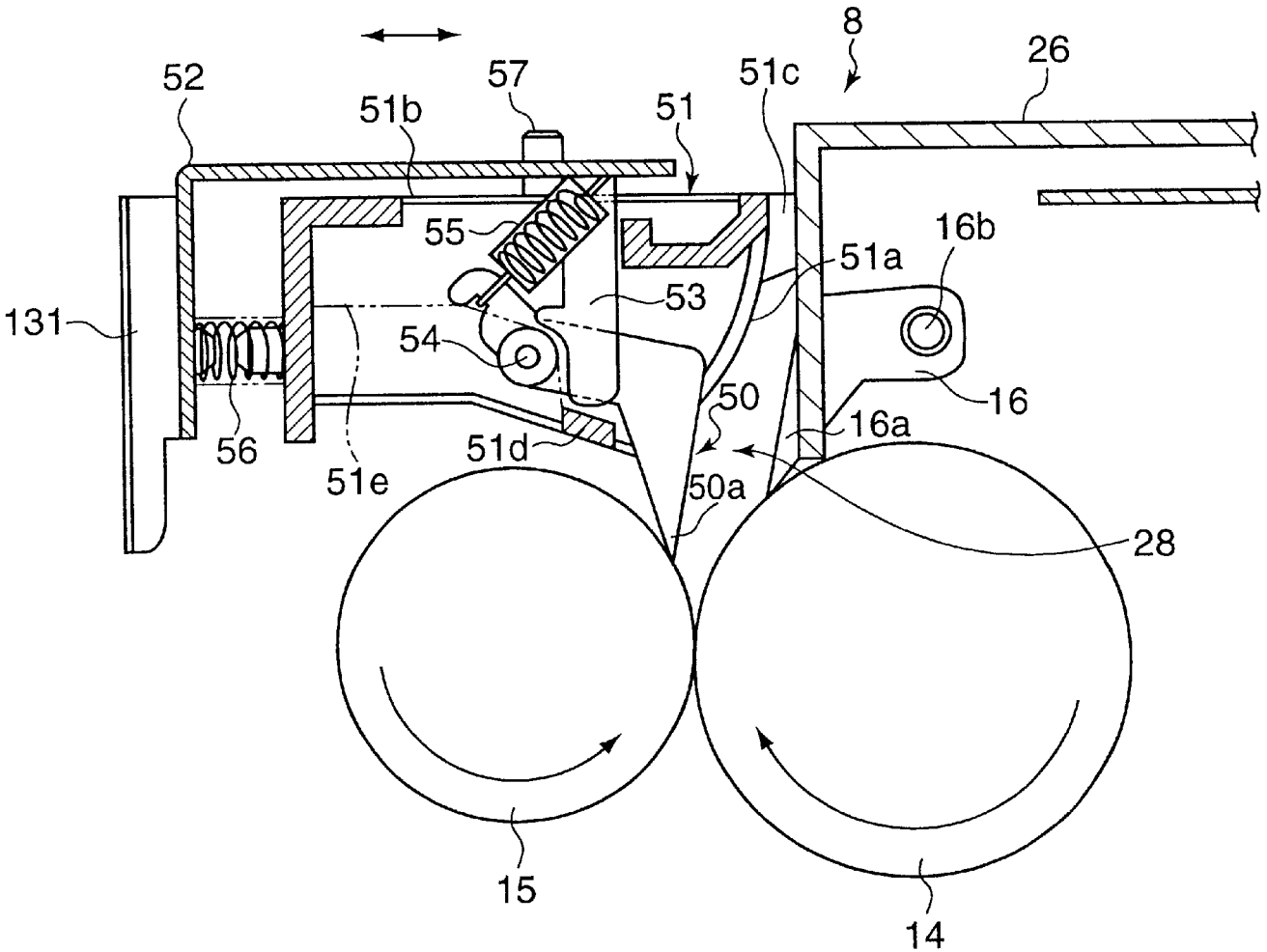
FIG. 28 is a sectional view showing a general construction of the fixing device in the vicinity of an outlet opening section.
Figure 29:
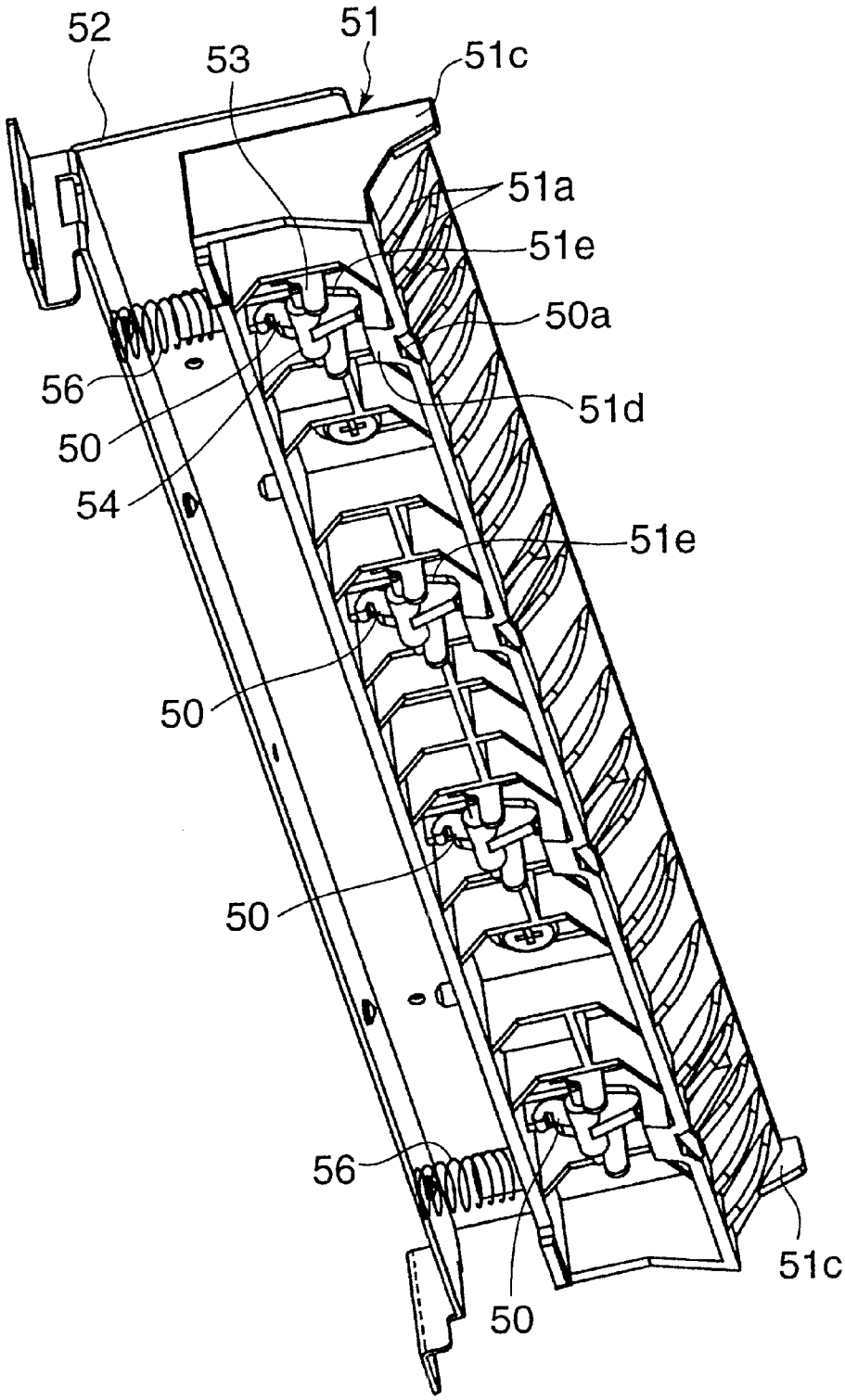
FIG. 29 is a perspective diagram showing a guide member constituting a portion of the fixing device, being viewed from below.

FIG. 28 is a sectional view showing a schematic construction of the vicinity of the outlet opening section 28 in the fixing device 8, and FIG. 29 is a perspective diagram viewing the guide member 51 forming a portion of the fixing device 8, viewed from below.

The separating member 50 for separating recording paper from the pressing roller 15 has an approximate L shape in side view and is arranged inside the guide member 51. The separating member 50 is held such that the rotational support axle 54 thereof rotates freely while rubbing against a rib 51*e* of the guide member 51, and also such that the separating member 50 itself can perform sliding movement with respect to the rib 51*e*. Furthermore, the separating member 50 is designed such that a rotational force is generated therein about the rotating support axle 54 by means of a tensile spring 55, and such that the front end section (claw) 50*a* thereof abuts on the surface of the pressing roller 15. This tensile spring 55 is attached to a support plate 52 via an opening in the guide member 51. By adopting a construction of this kind, the separating member 50 is able to rise up freely from the guide member 51 by rotating. Moreover, if the front end section 50*a* of the separating member 50 is pressed upwards by paper being conveyed past the same, the separating member 50 is displaced upwards such that the front end section 50*a* of the separating member 50 acts to separate the recording paper adhering to the pressing roller 15 without becoming pushed into the pressing roller 15.

The guide member 51 is mounted slidably on the support plate 52, the side portions of the guide member 51 being attached to the support plate 52 by means of push springs 56 which press it towards the heating roller 14. Furthermore, the guide member 51 is structured and arranged such that the upper face portion 51b thereof is interposed between the separating member 50 and the support plate 52, a pin 57 being provided in this upper face portion 51*b*. The pin 57 engages with an elongated hole section formed in the support plate 52 which thereby restricts the movement of the guide member 51 such that it may only travel in the direction of the arrow in FIG. 28.

A guide surface 51*a* for guiding the recording paper outputted from the outlet opening section 28 is formed on the portion of the guide member 51 that faces the heating roller 14, and projecting sections 51*c* are provided on either side portion thereof. These projecting sections 51*c* are formed to abut on the guide surface 51*a* on the second casing 26, when the side cover 131 (support plate 52) of the image forming apparatus is closed and the separating members 16, 50 are set with respect to the heating roller 14 and pressing roller 152. The projecting sections 51*c* perform the role of restricting the urging or biasing force of the push springs 56 and stabilizing the positions of the members such that the support plate 52 and the guide member 51 are held in predetermined positions a predetermined distance apart when the side cover 131 is closed.

An engaging section 51*d* which is engageable with the separating member 50, and ribs 51*e* which rub against the rotational support axle 54 of the separating member 50 are provided on the inner side of the guide member 51. When the projecting sections 51*c* abut on the guide surface 51*a* and the guide member 51 is pressed towards the support plate 52, the rotational support axle 54 assumes a position abutting against the ribs 51*e* such that the separating member 50 is caused to come into contact with the pressing roller 15 by the rotational force of the tensile spring 55. Moreover, when the contact between the projecting sections 51*c* and the guide surface 51*a* is released and the guide member 51 is moved towards the heating roller 14 under the urging or biasing force of the springs 56, the rotational support axle 54 of the separating member 50 engages with the bearing sections 53 extending downwards from the support plate 52, such that the engaging section 51*d* presses against the separating member 50 and is caused to rotate upwards.

As illustrated in FIG. 29, the guide member 51 has a long shape in the direction of the rotational axis of the pressing roller 15, and in the present embodiment, four separating members 50 are provided in parallel in a longitudinal direction. The four separating members 50 are each displaced in conjunction with the movement of the guide member 51, according to the construction described above. Furthermore, the projecting sections 51*c* of the guide member 51 are formed at each end portion of the guide member 51 in the longitudinal direction thereof such that the recording paper from the heating roller 14 and pressing roller 15 is conveyed in a smooth fashion.

Next, the operation of the separating member 50 and the guide member 51 is described in a case where the side cover 131 of the image forming apparatus 1 is opened.

Figure 30:
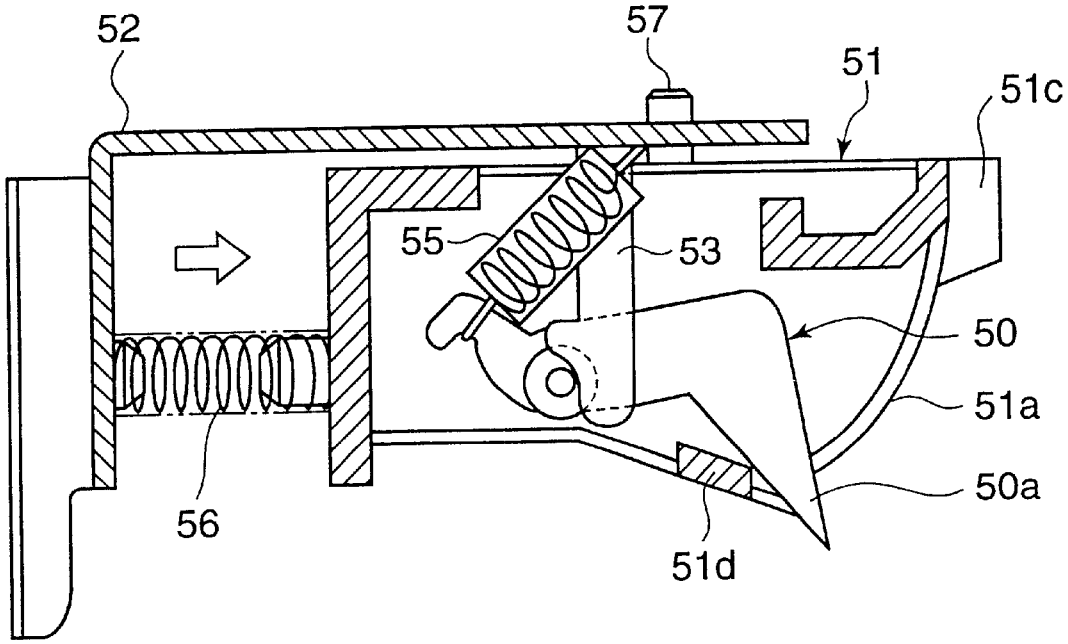
FIG. 30 is an explanatory diagram showing operation of the guide member and the separating member when the side cover is opened.

FIG. 30 is an explanatory diagram showing the operation of a guide member 51 and the separating member 50 when the side cover 131 is opened.

The aforementioned support plate 52, guide member 51 and separating member 50 are mounted on the side cover 131 such that the support plate 52, guide member 51 and separating member 50 are retracted from the pressing roller 15 with the opening and closing action of the side cover 131.

The guide member 51 and the separating member 50 are positioned over the pressing roller 15 when the side cover 131 indicated by the solid lines in FIG. 27 is in the closed state. The projecting sections 51*c* of the guide member 51 press against the guide surface 51*a* of the heating roller 14, thereby restricting the urging or biasing force of the push springs 56, and causing the guide member 51 to be pressed into the support plate 163. In this position, as shown in FIG. 28, the front end section 50*a* of the separating member 50 is set in a state abutting against the pressing roller 15 by means of the rotational force generated by the tensile force of the tensile spring 55.

If the side cover 131 is opened as indicated by the double-dotted lines in FIG. 27, the guide member 51 moves accordingly, the contact between the projecting sections 51*c* and the guide surface 51*a* is released, and the guide member 51 moves in the direction of the arrow shown in FIG. 30 under the urging or biasing force of the push springs 56. By means of the movement of the guide member 51, the rotational support axle 54 of the separating member 50 engages with the bearing sections 53, the engaging section 51*d* presses against the separating member 50, and the separating member 50 rotates upwards, thereby withdrawing the front end section 50*a* thereof from the pressing roller 15.

According to this construction, when the side cover 131 is opened, the guide member 51 moves, and the separating member 50 is withdrawn from the pressing roller 15, and when the side cover 131 is closed, the guide member 51 moves and the separating member 50 is caused to come into contact with the pressing roller 15.

In a conventional image forming apparatus, there has been proposed a construction wherein a separating member is mounted rotatably on a portion of the opening and closing unit, and the front end of the separating member is withdrawn without causing interference with the fixing roller by means of the portion of the unit where the separating member is mounted performing a sliding motion coupled to the opening and closing action of the unit (see, for example, Japanese Unexamined Patent Publication No.2000-264520). However, since this construction must comprise a structure which allows a member to which the separating member is attached to slide with respect to the opening and closing unit, then a large number of component parts are required, assembly is complicated, and the positional accuracy of the separating member will be poor due to variations in the precision of component dimensions. Moreover, metal plate or the like must be used for the member to which the separating member is attached in order to obtain sufficient strength, and therefore the heater from the fixing roller is readily transmitted via the separating member and it is necessary to implement heat protection measures.

In view of the foregoing, according to construction in accordance with the present invention, it is possible to achieve coupling of the opening and closing action of the side cover 131 for the purpose of resolving paper jams, or the like, in the image forming apparatus 1, with the movement of the guide member 51, and coupling between the movement of the guide member 51 and the rotational motion of the separating member 50, by means of a simple construction. Therefore, the number of parts required to cause the separating member 50 to be pressed against the pressing roller 15 or to be withdrawn from the pressing roller 15 is reduced, and hence the amount of assembly operation involved is reduced. Furthermore, the simpler the construction adopted, the greater the precision achieved in coupling the operation of the side cover 131 of the image forming apparatus 1 with the contact/withdrawal operation of the separating member 50.

Moreover, since the outer side surfaces of the guide member 51 are interposed between the side cover 131 and the separating member 50, the heat from the heating roller 14, or the like, is not liable to be transmitted to the side cover 131. This provides further heat protection measures for the user when he or she has opened the side cover 131 in order to deal with a paper jam, or the like.

The present invention is described in accordance with the above embodiments, but the dimensions, materials, shapes, relative configurations, and the like, of the constituent parts described in this embodiment are simply examples, and unless stated explicitly otherwise, the scope of the invention is not limited thereto. Moreover, the fixing device relating to the present invention and the image forming apparatus provided with the same may also be composed as follows.

Figure 31:
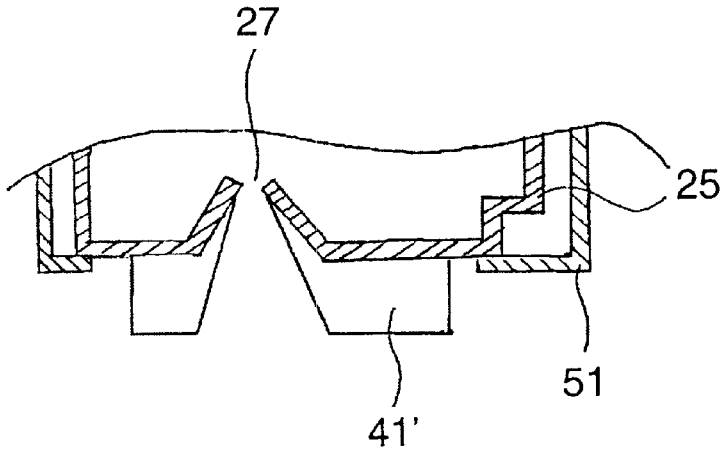
FIG. 31 is a sectional view showing a modification wherein high rib projections are provided in the vicinity of an inlet opening section.

(1) In the foregoing embodiment, the construction is adopted that the rib-shaped projections 41 in the vicinity of the inlet opening section 27 of the first casing 25 is lower than the projecting sections 42 to the front and rear thereof. However, as shown in FIG. 31, it is possible to provide a high rib-shaped projection 41' in the vicinity of the inlet opening section 27. By so doing, the rib-shaped projection 41' is more exposed to the air flowing inside the image forming apparatus 1 and therefore a better cooling effect is obtained.

(2) In the aforementioned embodiment, the rib-shaped projections 41 are provided at the inlet opening section 27 on the first casing. However, they may also be provided at the outlet opening section 28.

Figure 32:
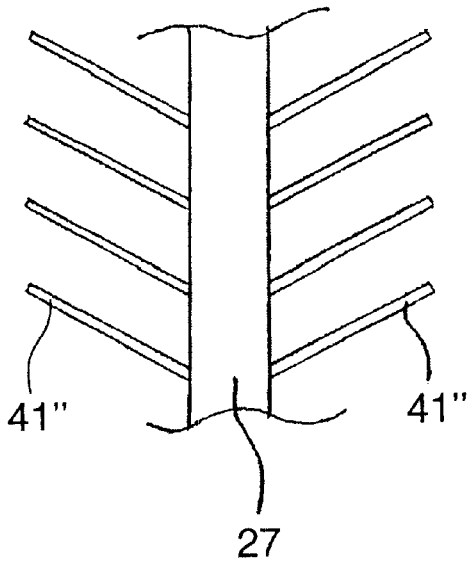
FIG. 32 is a bottom view showing another modification wherein rib-shaped projections are provided in the vicinity of the inlet opening section at an oblique angle with respect to the longitudinal direction of the inlet opening section.

(3) In the aforementioned embodiment, the rib-shaped projections 41 in the vicinity of the inlet opening section 27 of the first casing 25 are formed orthogonally with respect to the longitudinal direction of the inlet opening section 27. However, as shown in FIG. 32, rib-shaped projections 41" may be provided in an oblique fashion with respect to the longitudinal direction of the inlet opening section 27. By so doing, the direction in which the gaps between the rib-shaped projections 41" extend are not liable to be parallel to the direction in which they are touched by the user's fingers, and hence the user's fingers are not liable to enter into the gaps between the rib-shaped projections 41". Design freedom is increased by, for example, setting the gap between the rib-shaped projections 41" to 10 mm or above.

Moreover, in the case of an image forming apparatus 1 in which air ventilation flows in the front/rear direction in the vicinity of the fixing device 8 mounted in the image forming apparatus 1, this air is more liable to enter into the gaps between the rib-shaped projections 41", and hence the cooling effects can be further enhanced.

(4) In the embodiment described above, the fixing roller unit is mounted in the first casing 25 during assembly by first assembling the front frame 291 and the rear frame 301 with the first casing 25 and then mounting the heating roller 14, pressing roller 15, and the like, thereon. However, it is possible to assemble the first casing 25 after first mounting a fixing roller unit, in the state illustrated in FIG. 6.

(5) In the embodiment described above, the positioning projections 31 for registering the position of, i.e., fixing the position of or positioning, the fixing device 8 with respect to the image forming apparatus 1 are provided in a plane parallel to the plane containing the rotational axes of the heating roller 14 and pressing roller 15. However, they may also be provided in the plane containing the rotational axes of the rollers 14, 15.

Figure 33:
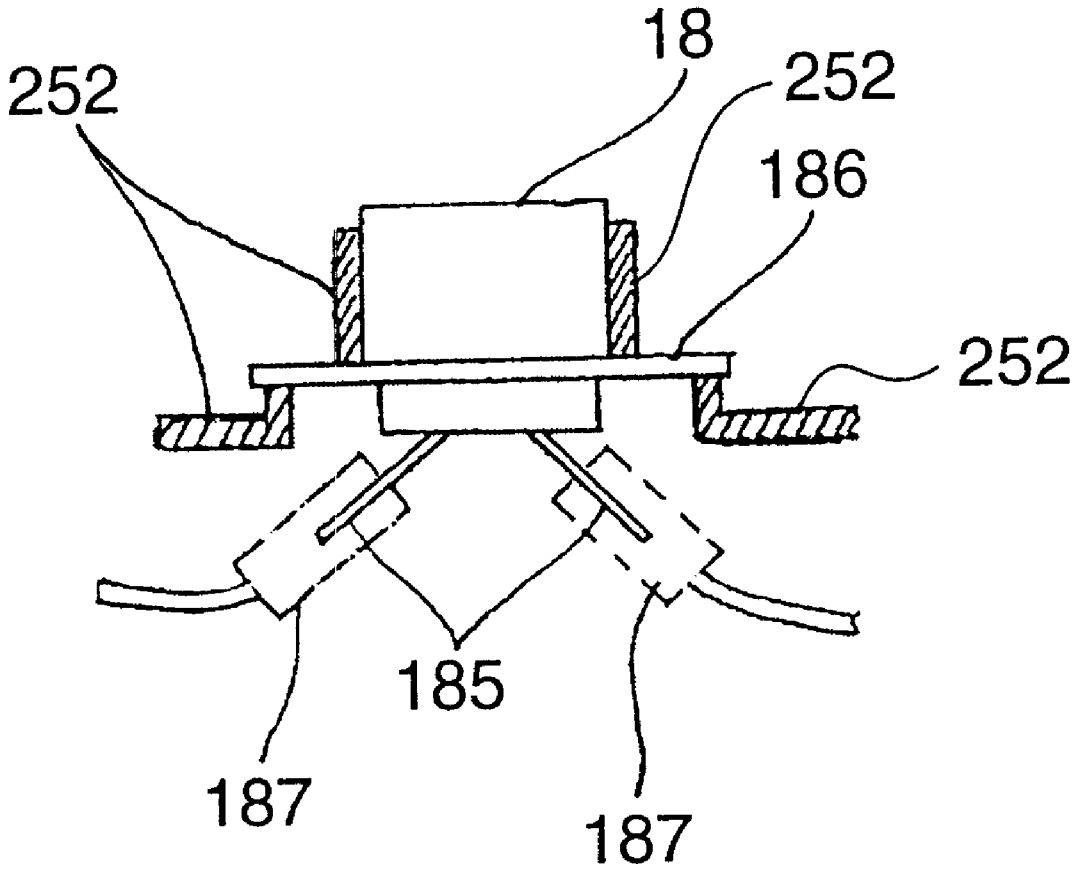
FIG. 33 is a plan view illustrating a modified mounting of a thermostat coupled by a connector.

(6) In the embodiment described above, a thermostat 18 is used to which the electrical wires are connected by screws 182, and therefore nuts for fastening these screws 182 are taken as the fastening tools 181. However, it is possible for the body of the thermostat 18 alone to be supported by the sensor mounting rib 252 of the first casing 25 and for the fastening tools to be omitted. For example, as shown in FIG. 33, in the case of a thermostat 18' wherein an electrical wiring terminal section 187 is connected by push insertion to a terminal section 185 provided in the thermostat 18', it is possible for the sensor mounting rib 252 to be constituted by a plurality of ribs such that knob portions 186 of the thermostat 18' are held by being gripped in the recesses formed by the gaps between the plurality of ribs. By so doing, the fastening tools become unnecessary and hence the number of components can be further reduced, accordingly.

(7) In the embodiment described above, the thermistor 17 is mounted by screws 172 onto the thermistor mounting section 256 on the first casing 25. However, similarly to the mounting structure for the thermostat 18, the thermistor 17 may also be mounted such that it is gripped between the first casing 25 and the second casing 26.

Figure 34A:
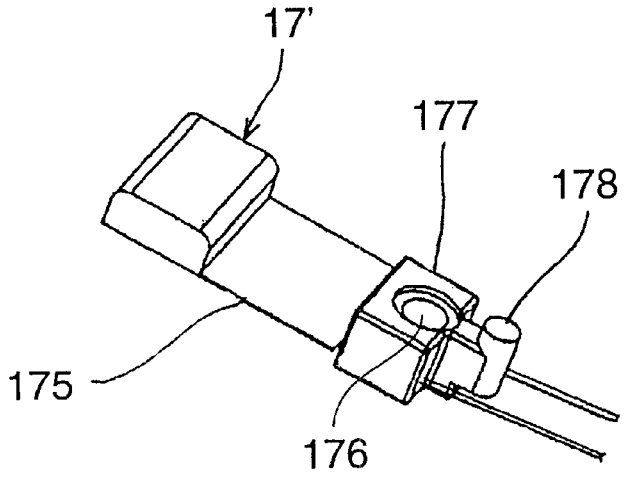
FIG. 34A is a perspective view illustrating a modified mounting of a thermistor.
Figure 34B:
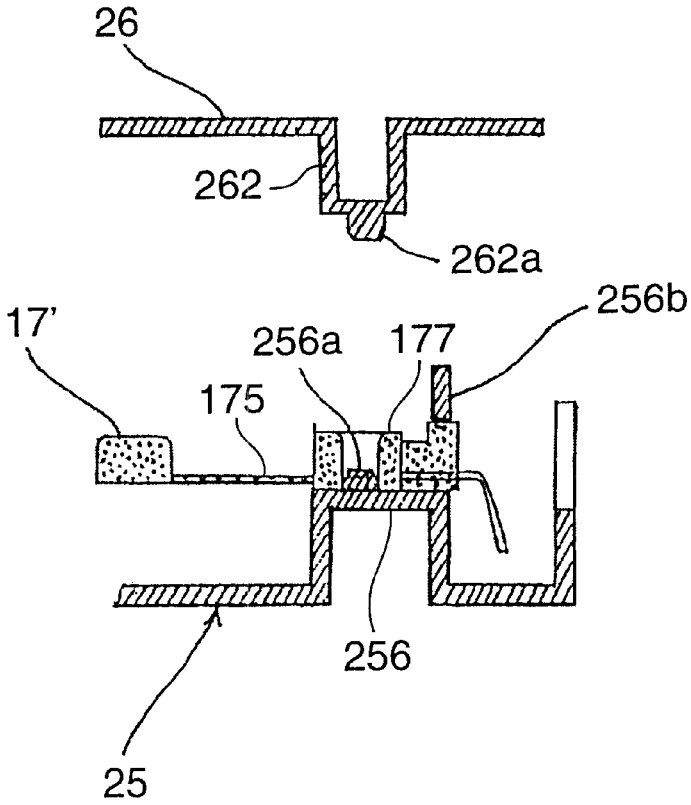
FIG. 34B is a sectional view showing the mounted state of the thermistor.
Figure 35:
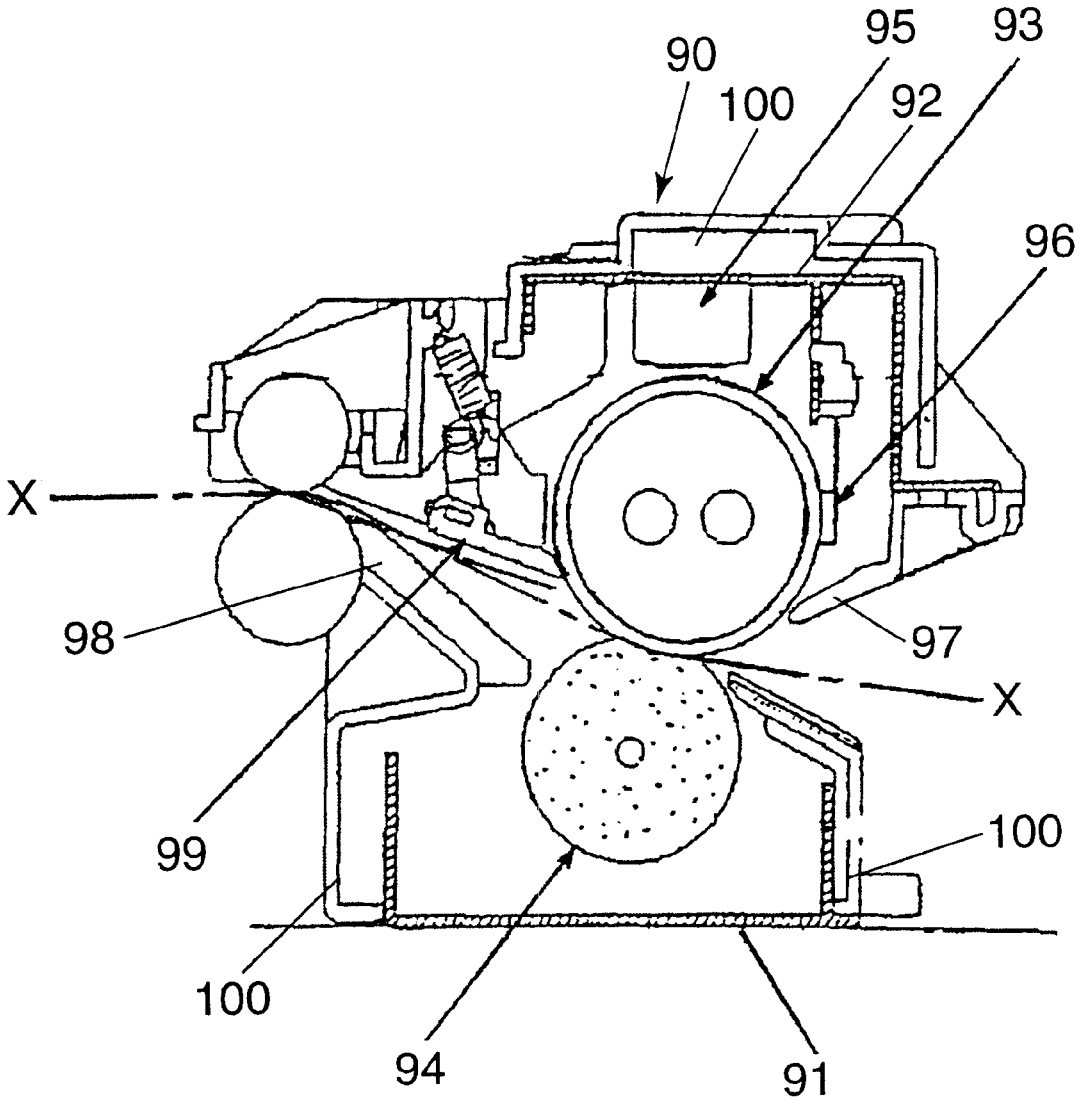
FIG.35 PRIOR ART
FIG. 35 is a sectional view showing a conventional fixing device.

FIG. 34 is a diagram showing an additional manner for mounting the thermistor 17'. FIG. 34A is a perspective view of the thermistor 17', and FIG. 34B is a sectional view showing the thermistor 17' in a mounted state. As shown in FIGS. 34A and 34B, the thermistor 17' is mounted via an elastic member 175 on a sensor mounting member 177 made of heat-resistant resin and formed with a through hole 176 and butting projection 178.

On the thermistor mounting 256 of the first casing 25, there are formed a boss 256*a* which is inserted into the through hole 176 of the sensor mounting member 177 and registers the position of (i.e., regulates the position of or positions) the thermistor 17', and a receiving section 256*b* for receiving the aforementioned butting projection 178. On the second casing 26, there is formed the thermistor pressing section 266 which comprises a boss 266*a* that is inserted into the through hole 176 in the sensor mounting member 177 and fixes the position of the thermistor 17'.

The thermistor 17' is inserted in the direction of the arrow through the thermistor mounting hole 255 provided in the first casing 25, and the through hole 176 of the sensor mounting member 177 is fixed in position by the boss 256*a*, in which state, the thermistor 17' is mounted on the thermistor mount 256. In this case, since the butting projection 178 is in a state of approximate contact with the receiving section 256*b*, then even when the heating roller is assembled and the thermistor 17' makes slight pressure contact with the heating roller 14, the confronting portion thereof 17*c* will not be lift up and the sensor mounting member 177 will not become detached from the boss 256*a*. If the second casing 26 is then placed thereon in this state, the boss 266*a* of the thermistor pressing section 266 is inserted into the through hole 176 of the sensor mounting member 177, thereby fixing the position of same, and the sensor mounting member 177 become fixed between the thermistor mount 256 and the sensor pressing section 266.

By adopting this construction, it is possible to secure the thermistor 17' without using fixing members, such as screws, or the like, and hence the number of components involved can be reduced and ease of assembly is improved.

(8) In the construction described above, the separating member 16 for the heating roller 14 is mounted in the second casing 26, and the separating member 50 for the pressing roller 15 is constructed so as to abut against or withdraw from the pressing roller 15 in accordance with the movement of a guide member 51. However, an inverse construction may also be used. Moreover, both separating members may be mounted in the second casing 26, or a separating member may be provided for one of the rollers only.

(9) The shape of the connector 33 is not limited to the shape described in the foregoing embodiment, it being possible to adopt connectors of various shapes, as well as using existing connectors employed in the prior art.

(10) In the embodiment described above, the connector 33 is held on the case by fitting projecting sections (first holding sections 257*b*, 267*b*) formed on the first casing 25 and the second casing 26 into recesses 333 formed on the connector 33. However, these members may also be mutually fitted together by forming projecting sections on the connector 33 and recesses on the first casing 25 and the second casing 26.

(11) In the embodiment described above, the construction for mounting the connector 33 on the fixing device 8 is disclosed. However, a similar construction may be in other units which require connection to the main body of the image forming apparatus 1, such as the developing unit, cleaning unit, transfer unit, paper conveyance unit, paper feed unit, paper feed cassette, double-side copy feed unit, and the like.

(12) In the embodiment described above, an expanding coil is used for the spring 45. However, it is possible to use other elastic members, such as a tensile coil, or the like.

(13) In the embodiment described above, the rotational axle support sections 16*c* are formed with a substantially oval shape. However, any elliptical shape or the like may be used, provided that it has a non-circular cross-section comprising a long diameter section and a short diameter section.

(14) In the embodiment described above, the construction for providing slits in the bearing ribs 26*a* supporting the separating member 16 in the second casing 26 is disclosed. However, any kind of construction may be used provided that it permits the separating hook rotating axle 16*b* of the separating member 16 to be supported in a rotatable fashion, and hence there are no restrictions on the shape of the end sections 16*c* of the rotating axle or the slit-shaped bearing sections 26*a*.

This application is based on patent application Nos. 2000-271741, 2000-309767, 2000-363512, 2000-395967, 2000-401303, 2001-23993, 2001-41280, 2001-57415 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A fixing device for use in an image forming apparatus in which a toner image is transferred to and fixed on a recording paper, the fixing device comprising:

a pair of rollers adapted to be pressed together, at least one of said rollers being adapted for heating the recording paper; and a housing made of a heat-resistant resin and for accommodating the pair of rollers, the housing having an outside surface constituting an outside surface of the fixing device, the housing including a first casing and a second casing which are separable along the direction of conveyance of the recording paper in the fixing device, and the first casing having a mount section in which the pair of rollers are mounted in a predetermined position in the first casing, the second casing having a recording paper outlet opening through which the recording paper is conveyed.

2. The fixing device according to claim 1, wherein the second casing is provided with a retaining section for securing the pair of rollers in the predetermined position by pressing the pair of rollers onto the mount section of the first casing.

3. The fixing device according to claim 2, wherein the mount section of the first casing is structured and arranged to provisionally hold the pair of rollers in the predetermined position during assembly of the fixing device without the securing of the rollers by the retaining section of the second casing.

4. The fixing device according to claim 1, wherein each of the first and second casings is a molded article made of a heat-resistant resin.

5. The fixing device according to claim 1, further comprising roller support blocks for supporting opposite ends of the pair of rollers, wherein the mount section of the first casing holds the roller support blocks to support the pair of rollers in the predetermined position.

6. The fixing device according to claim 5, wherein each of the roller support blocks includes:

a roller support frame formed with a recess which receives an end of one of the pair of rollers;

a pressing lever formed with a recess which receives an end of the other of the pair of rollers, the pressing lever being rotatably mounted on the roller support frame with the recess of the pressing lever confronting the recess of the roller support frame;

an urging member for urging the pressing lever toward the roller support frame to cause pressing contact between the pair of rollers; and the mount section of the first casing supports the roller support frame to hold the pair of rollers in the predetermined position.

7. The fixing device according to claim 6, wherein the urging member includes a spring tensioned between the roller support frame and the pressing lever.

8. The fixing device according to claim 6, wherein the roller support frame includes a plate-shaped member having a bend edge section formed in at least one portion of the edge region thereof; and the mount section of the first casing includes a mounting rib projecting from the inner surface of the first casing to define a guide space for guiding and receiving the bend edge section of the roller support frame.

9. The fixing device according to claim 8, wherein the second casing is provided on the inside surface thereof with a retaining section for securing the pair of rollers in the predetermined position by pressing the roller support frame onto the mount section of the first casing, the retaining section includes a retaining rib projecting from the inside surface of the second casing to define a guide space for guiding and receiving a part of the periphery of the roller support frame.

10. The fixing device according to claim 8, wherein the plate-shaped member has a substantially square shape, and the bend edge section is formed at a plurality of sides of the plate-shaped member and extends perpendicular to the plate-shaped member.

11. The fixing device according to claim 8, wherein at least one of the bend edge sections is further bent and extends in parallel with the plane of the plate shape member.

12. The fixing device according to claim 1, wherein the first casing and the second casing are separable from each other at a plane substantially perpendicular to the direction of conveyance of the recording paper in the fixing device.

13. The fixing device according to claim 1, wherein the heating roller and the pressing roller are arranged in substantially horizontal fashion when the fixing device is mounted in the image forming apparatus.

14. The fixing device according to claim 13, wherein the fixing device is mounted in the image forming apparatus in an arrangement where the first casing is below the second casing.

15. The fixing device according to claim 13, wherein a recording paper inlet opening for allowing the recording paper to enter the fixing device or a recording paper outlet opening for allowing the recording paper to exit the fixing device is formed in the one of the first casing and the second casing that is in a lower position when the fixing device is mounted in the image forming apparatus, and a plurality of rib-shaped projections projecting outwards from the casing is formed on a wall defining the recording paper inlet opening or the recording paper outlet opening.

16. The fixing device according to claim 15, wherein the first casing is positioned below the second casing when the fixing device is mounted in the image forming apparatus, and the recording paper inlet opening is formed in the first casing.

17. The fixing device according to claim 16, wherein the plurality of rib-shaped projections define a placement plane for the first casing to be placed on a preparation table when the fixing device is assembled.

18. The fixing device according to claim 15, wherein the plurality of rib-shaped projections constitute a conveyance guide defining a conveyance path for the recording paper.

19. The fixing device according to claim 1, further comprising a temperature sensor for detecting the temperature of the heating roller, wherein the first casing is formed with a sensor mounting rib for holding the temperature sensor in a predetermined position in which the temperature sensor faces the heating roller.

20. The fixing device according to claim 19, wherein the sensor mounting rib extends in a longitudinal direction of the heating roller in the vicinity of the heating roller to serve as a thermal shield, and a connection wire for temperature sensor is arranged behind the sensor mounting rib.

21. The fixing device according to claim 19, wherein the second casing is formed with a sensor pressing rib on the inside surface thereof for pressing the temperature sensor against the sensor mounting rib of the first casing to secure the temperature sensor in the predetermined position.

22. The fixing device according to claim 21, wherein the temperature sensor is attached to a sensor attaching member which has a through hole, and the sensor mounting rib and the sensor pressing rib are respectively formed with projecting sections which are received in the through hole for positioning the sensor attachment member.

23. The fixing device according to claim 19, wherein the temperature sensor is attached to a sensor attaching member, and the sensor mounting rib is formed with a recess which receives the sensor attaching member.

24. The fixing device according to claim 23, wherein the sensor mounting rib includes a plurality of ribs forming the recess between the ribs.

25. The fixing device according to claim 1, wherein the first casing is formed with two positioning projections on an outside surface for positioning the fixing device in the image forming apparatus, and the positioning projections are spaced apart from each other by a distance larger than a distance between the axis of the heating roller and the axis of the pressing roller, the positioning projections being on an imaginary plane extending through the rotational axes of the heating roller and the pressing roller or on a plane parallel to the imaginary plane, and the positioning projections extending substantially parallel to the axial direction of the heating roller.

26. The fixing device according to claim 25, wherein the two positioning projections are located outside of a high temperature region as an area projected from the inside area of the heating roller in the axial direction of the heating roller.

27. The fixing device according to claim 1, further comprising:

a separating member including:

a claw adapted to come into contact with one of the pair of rollers to thereby separate the recording paper from the one of the pair of rollers;

a rotational axle integrally coupled with the claw for turning the claw around a rotational axis; and a projecting section projecting from the rotational axle in a direction perpendicular to the rotation axis, the projecting section having a curved end;

a bearing rib formed inside the second casing for rotatably supporting the rotational axle;

a restricting rib formed inside the second casing at a position confronting the projecting section, the restricting rib having a portion situated at the distance from the rotational axle that is less than the distance of the curved end of the projecting section from the rotational axis such that the restricting rib restrains the claw at a roller-contacting position when the claw is moved to the roller-contacting position beyond the portion of the restricting rib at that distance; and an urging member for urging the separating member in a rotational direction to cause the claw to come into contact with the one of the pair of rollers.

28. The fixing device according to claim 27, wherein:

the rotational axle has an end having a substantially oval shape in cross-section including a pair of opposed arcuate portions and a pair of opposed flat portions;

the bearing rib being formed with a slit having a narrow section which is open to the outside and an enlarged section which have a dimensional relationship $C<A<D<B$, wherein A is a width of the narrow section of the slit, B is a width of the enlarged section of the slit, C is a distance between the flat portions of the rotational axle, and D is a distance between midpoints of the arcuate portions of the rotational axle; and the rotational axle being inserted into the slit with the flat portions passing through the narrow section and then the claw being turned when the rotational axle enters the enlarged section of the slit, thereby mounting the separating member inside the second casing.

29. An image forming apparatus including the fixing device according to claim 1 and further comprising:

a cover member movable between an open position and a closed position, the fixing member further comprising:

a separating member adapted to be brought into contact with one of the pair of rollers to separate the recording paper from the one of the pair of rollers; and a guide member for guiding the recording paper passing through the pair of rollers the guide member being coupled to the cover member and movable therewith, the separating member being coupled to the guide member to come into contact with and move away from the one of the pair of rollers with the movement of the guide member.

30. The image forming apparatus according to claim 29, wherein:

the separating member is rotatably supported on the cover member and has a claw portion adapted to be brought into contact with the one of the pair of rollers and a biasing member for biasing the claw portion into contact with the one one of the pair of rollers; and the guide member includes an engaging member engaging the separating member with the movement of the guide member in response to the movement of the cover member to the open position, with the engaging member pushing the separating member against the force of the biasing member to cause the separating member to move away from the one of the pair of rollers.

31. The image forming apparatus according to claim 30, wherein:

the guide section is urged in a direction to move the separating member away from the one of the pair of rollers; and the guide member is coupled to the cover member such that the biasing force for the guide member is effected when the cover member is in the open position and the biasing force is suppressed to allow the claw portion of the separating member to engage the one of the pair of rollers when the cover member is in the closed position.

32. The image forming apparatus according to claim 31, wherein a portion of the guide member is interposed between the unit and the separating member.

33. An image forming apparatus including the fixing device according to claim 1 and further comprising a main body, the fixing device being formed as a unit insertable into the main body of the image forming apparatus in the axial direction of the heating roller mountable in the main body, the fixing device further comprising a connection member for electrically connecting the fixing device with the main body of the image forming apparatus, and wherein the first casing and the second casing are each formed with cutaway sections for receiving the connection member.

34. The fixing device according to claim 33, wherein the cutaway sections each are shaped to be larger than the external dimension of the connection member.

35. The fixing device according to claim 34, wherein one of the connection member and the cutaway section is formed with a projection, and the other of the connection member and the cutaway section is formed with a recess in which the projecting section fits, and the recess is larger than the projecting sections in the direction of insertion.

36. The fixing device according to claim 33, wherein the connection member is supported by the first casing and the second casing in a plurality of separate locations in the direction of insertion.

37. An image forming apparatus for forming an image on recording paper, comprising:

an image forming section for transferring a toner image onto recording paper; and a fixing device for fixing the toner image transferred to the recording paper while the recording paper is conveyed through the fixing device;

wherein the fixing device includes:

a heating roller for heating the recording paper;

a pressing roller for pressing the recording paper against the heating roller; and a housing made of a heat-resistant resin and for accommodating the heating roller and the pressing roller, the housing including a first casing and a second casing which are separable along the direction of conveyance of the recording paper in the fixing device;

the first casing having a mount section in which the heating roller and pressing roller are mounted in fixed positions in the first casing, the second casing having a recording paper outlet opening through which the recording paper is conveyed.

38. The image forming apparatus according to claim 37, further comprising:

a cover member movable between an open position and a closed position, and a guide member for guiding the recording paper passing through a gap between the pair of rollers, the guide member being coupled to the cover member and movable therewith, the fixing device further including a separating member adapted to contact one of the pair of rollers to separate the recording paper therefrom, the separating member being coupled to the guide member to come into contact with and move away from the one of the pair of rollers dependent on movement of the guide member.

39. The image forming apparatus according to claim 38, further comprising:

a first biasing member arranged between the cover member and the guide member for biasing the cover member and the guide member to move away from each other;

a second biasing member for biasing the separating member into contact with the one of the rollers;

a first contact member integrally formed on the guide member and adapted to be brought into contact with the separating member to cause the separating member to disengage from the one of the rollers under the force of the second biasing member when the cover member is in the open position; and a second contact member associated with the guide member and adapted to be brought into contact with the second casing of the fixing device to suppress the first biasing member thereby allowing the separating member to be in contact with the one of the pair of rollers when the cover member is in the closed position.

* * * * *